US009982222B2

(12) United States Patent
Makino et al.

(10) Patent No.: US 9,982,222 B2
(45) Date of Patent: May 29, 2018

(54) DETERGENT COMPOSITION

(71) Applicant: LION CORPORATION, Tokyo (JP)

(72) Inventors: Makoto Makino, Tokyo (JP); Atsushi Tsuda, Tokyo (JP); Takuya Tsutsui, Tokyo (JP)

(73) Assignee: Lion Corporation (JP)

( * ) Notice: Subject to any disclaimer, the term of this patent is extended or adjusted under 35 U.S.C. 154(b) by 0 days. days.

(21) Appl. No.: 14/896,635

(22) PCT Filed: Jun. 12, 2014

(86) PCT No.: PCT/JP2014/065565
§ 371 (c)(1),
(2) Date: Dec. 7, 2015

(87) PCT Pub. No.: WO2014/200050
PCT Pub. Date: Dec. 18, 2014

(65) Prior Publication Data

US 2016/0122694 A1 May 5, 2016

(30) Foreign Application Priority Data

Jun. 12, 2013 (JP) ..... 2013-123943

(51) Int. Cl.
*C11D 3/50* (2006.01)
*C11D 1/28* (2006.01)

(52) U.S. Cl.
CPC . *C11D 3/50* (2013.01); *C11D 1/28* (2013.01)

(58) Field of Classification Search
CPC .. C11D 1/02; C11D 1/28; C11D 1/146; C11D 3/50
See application file for complete search history.

(56) References Cited

U.S. PATENT DOCUMENTS

| | | | | |
|---|---|---|---|---|
| 4,822,516 | A | 4/1989 | Suzuki et al. | |
| 5,614,484 | A * | 3/1997 | Panandiker | C11D 3/38627 510/102 |
| 5,929,022 | A * | 7/1999 | Velazquez | C11D 1/40 510/101 |
| 6,852,681 | B1 * | 2/2005 | Kerschner | C11D 17/0073 510/151 |
| 2010/0305343 | A1 | 12/2010 | Abe et al. | |
| 2011/0152157 | A1 * | 6/2011 | Woo | A61L 9/01 510/236 |

FOREIGN PATENT DOCUMENTS

| | | | |
|---|---|---|---|
| EP | 0001004 | A1 | 3/1979 |
| EP | 0414221 | A2 | 2/1991 |
| EP | 1634941 | A1 | 3/2006 |
| JP | 54052196 | A | 4/1979 |
| JP | 63264699 | A | 11/1988 |
| JP | 03186307 | A | 8/1991 |
| JP | 05025492 | A | 2/1993 |
| JP | 6510077 | A | 11/1994 |
| JP | 2918991 | B | 7/1999 |
| JP | 2004189893 | A | 7/2004 |
| JP | 2005187579 | A | 7/2005 |
| JP | 2007517945 | A | 7/2007 |
| JP | 2010209293 | A | 9/2010 |
| JP | 2010209294 | A | 9/2010 |
| JP | 2012140555 | A | 7/2012 |
| JP | 2012233042 | A | 11/2012 |
| JP | 2013513460 | A | 4/2013 |
| WO | 9304158 | A1 | 3/1993 |
| WO | 9706235 | A1 | 2/1997 |
| WO | 2004111166 | A1 | 12/2004 |
| WO | 2005068601 | A1 | 7/2005 |
| WO | 2009054406 | A1 | 4/2009 |
| WO | 2010103832 | A1 | 9/2010 |
| WO | 2011084377 | A1 | 7/2011 |

OTHER PUBLICATIONS

Japanese Patent Office, "International Search Report" in connection with related International Application No. PCT/JP2014/065565, dated Aug. 12, 2014, 4 pages.
Hillebrecht, Dieter, Examiner, European Patent Office, "Extended European Search Report" in connection with related European Patent Application No. 14811021.6, dated Jan. 31, 2017, 6 pages.
Japanese Patent Office, Notice of Reasons for Rejection for Japanese Application No. 2015-522851, dated Aug. 8,2017, 8 pages (including translation).

* cited by examiner

*Primary Examiner* — John R Hardee
(74) *Attorney, Agent, or Firm* — Kolisch Hartwell, P.C.

(57) ABSTRACT

A detergent composition containing an α-sulfo fatty acid alkyl ester salt and a fragrance composition, wherein the amount of the α-sulfo fatty acid alkyl ester salt is from 1 to 30% by mass relative to the total mass of the detergent composition, the fragrance composition contains a fragrance (A) described below, and the amount of the fragrance (A) is from 0.07 to 0.5% by mass relative to the total mass of the detergent composition. Fragrance (A): a fragrance composed of at least one fragrance component selected from the group consisting of dihydromyrcenol, isobornyl acetate, α-hexyl cinnamic aldehyde, lilial, tetrahydrolinalool, amyl salicylate, verdox, vertenex, tricyclodecenyl acetate, tricyclodecenyl propionate, Iso E Super and habanolide.

12 Claims, No Drawings

DETERGENT COMPOSITION

TECHNICAL FIELD

The present invention relates to a detergent composition.

Priority is claimed on Japanese Patent Application No. 2013-123943, filed Jun. 12, 2013, the content of which is incorporated herein by reference.

BACKGROUND ART

Neutral salts of sulfonated products of fatty acid alkyl esters are frequently also referred to as α-sulfo fatty acid alkyl ester salts (or α-sulfo fatty acid ester salts), and are surfactants which not only exhibit favorable hard water resistance and biodegradability, but also offer excellent detergency while being mild on the skin. Further, because α-sulfo fatty acid alkyl ester salts are a reusable natural raw material, they are also useful from the viewpoint of protecting the global environment. Moreover, α-sulfo fatty acid alkyl ester salts are available commercially in the form of flakes and powders and the like, and each of these types of commercial product are readily available.

For the reasons outlined above, α-sulfo fatty acid alkyl ester salts are often blended into detergents for textile products such as clothing.

However, α-sulfo fatty acid alkyl ester salts have a distinctive raw material odor, and when added to detergents, tend to cause an unpleasant odor that can adversely effect the fragrance of the product. For example, in the case of a granular detergent product in which a granular detergent is stored inside a sealed container, when the container is opened to use the granular detergent product, the odor that has accumulated in the head space inside the container can sometimes cause the user some unpleasantness.

Further, in order to differentiate a detergent composition and enhance its commercial value, a fragrance is often added to the detergent in order to impart a favorable aroma. However, if the detergent contains an α-sulfo fatty acid alkyl ester salt, then the odor of the α-sulfo fatty acid alkyl ester salt may inhibit the development of the aroma from the fragrance, which can impair the commercial value.

It is known that the substances responsible for the odors derived from α-sulfo fatty acid alkyl ester salts (namely, the odorous components) are lactones (lactone-containing compounds). It is thought that these odorous components are generated during the production process or the like as a result of decomposition of the α-sulfo fatty acid alkyl ester salt itself or impurities derived from the natural raw materials (paragraph [0032] of Patent Document 1).

PRIOR ART LITERATURE

Patent Documents

Patent Document 1: Japanese Unexamined Patent Application, First Publication No. 2005-187579

DISCLOSURE OF INVENTION

Problems to be Solved by the Invention

The present invention has been developed in light of the above circumstances, and has an object of providing a detergent composition with a favorable aroma in which the effects of odors derived from α-sulfo fatty acid alkyl ester salts are suppressed.

Means for Solving the Problems

As a result of intensive investigation, the inventors of the present invention obtained the following findings.

If a specific amount of a fragrance component (fragrance (A)) selected from a group consisting of 12 specific compounds is added to a detergent composition containing an α-sulfo fatty acid alkyl ester salt, then an effect is obtained in which the unpleasant odor caused by odorous components derived from the α-sulfo fatty acid alkyl ester salt is suppressed, and another effect is obtained in which any inhibition by the aforementioned odorous components on the development of the aroma from another fragrance (fragrance (B)) that is added for the purpose of differentiating the detergent composition is also suppressed. As a result, the true aroma of the fragrance (B) is able to develop, meaning the detergent composition has a favorable aroma.

When these effects were investigated further, the inventors discovered that the amount of alkyl methyl ketones having an alkyl chain length of 4 to 8 contained within the head space portion when a detergent composition containing an α-sulfo fatty acid alkyl ester salt was stored in a sealed container was a particularly effective indicator of the above effects. In other words, the smaller the amount of these alkyl methyl ketones, the less the unpleasant odor caused by the odorous components derived from the α-sulfo fatty acid alkyl ester salt, meaning the development of the aroma of the fragrance (B) was less likely to be inhibited, resulting in an improved product aroma.

The present invention was developed on the basis of the above findings, and has the aspects described below.

A first aspect of the present invention is a detergent composition containing an α-sulfo fatty acid alkyl ester salt and a fragrance composition, wherein the amount of the α-sulfo fatty acid alkyl ester salt is from 1 to 30% by mass relative to the total mass of the detergent composition, the fragrance composition contains a fragrance (A) described below, and the amount of the fragrance (A) is from 0.07 to 0.5% by mass relative to the total mass of the detergent composition.

Fragrance (A): a fragrance composed of at least one fragrance component selected from the group consisting of dihydromyrcenol, isobornyl acetate, α-hexyl cinnamic aldehyde, lilial, tetrahydrolinalool, amyl salicylate, verdox, vertenex, tricyclodecenyl acetate, tricyclodecenyl propionate, Iso E Super and habanolide.

A second aspect of the present invention is a detergent composition containing an α-sulfo fatty acid alkyl ester salt and a fragrance composition, wherein the amount of the α-sulfo fatty acid alkyl ester salt is from 1 to 30% by mass relative to the total mass of the detergent composition, the fragrance composition contains a fragrance (A) described below, the amount of the fragrance composition is from 0.25 to 1% by mass relative to the total mass of the detergent composition, and the amount of the fragrance (A) within the fragrance composition is at least 20% by mass relative to the total mass of the fragrance composition.

Fragrance (A): a fragrance composed of at least one fragrance component selected from the group consisting of dihydromyrcenol, isobornyl acetate, α-hexyl cinnamic aldehyde, lilial, tetrahydrolinalool, amyl salicylate, verdox, vertenex, tricyclodecenyl acetate, tricyclodecenyl propionate, Iso E Super, and habanolide.

In the detergent composition of the aforementioned first aspect or second aspect, it is preferable that the fragrance composition also contains a fragrance (B) described below, wherein the mass ratio of the fragrance (A) relative to the fragrance (B), represented by (mass of fragrance (A))/(mass of fragrance (B)), is at least 1 but not more than 10.

Fragrance (B): a fragrance composed of at least one fragrance component selected from the group consisting of 3,7-dimethyl-2,6-nonadienenitrile, allyl cyclohexyl propionate, triplal, 1,8-cineole, camphor, diphenyl oxide, β-naphthol methyl ether, citronellyl nitrile, dodecane nitrile, menthone, ethyl 2-methylbutyrate, ethyl 2-methylvalerate, citronellal, patchouli oil, n-heptanal, n-octanal, n-nonanal, 1-decanal, undecanal, dodecanal, 2-methylundecanal, 10-undecenal, terpineol-4, menthol, styralyl acetate, butyl acetate, isoamyl acetate, prenyl acetate, hexyl acetate, cis-3-hexenyl acetate, allyl amyl glycolate, cis-3-hexenol, ethyl 2-cyclohexyl propionate, fruitate, allyl hexanoate, allyl heptanoate, ethyl hexanoate, ethyl heptanoate, isomenthone, isocyclocitral, octyl isobutyrate, benzaldehyde, anisaldehyde, 1,4-cineole, allyl ionone, floropal, linalool oxide, rose oxide, cyclogalbanate, α-dynascone, α-damascone, β-damascone, γ-damascone, δ-damascone, β-damascenone, methyl heptenone, L-carvone, geranial, neral, 4-methyl-3-decen-5-ol, methyl pamplemousse, 3-methyl-1-isobutylbutyl acetate, ethyl butyrate, cashmeran, karanal, cedrol methyl ether, 2,2,6-trimethylcyclohexyl-3-hexanol, methyl naphthyl ketone, methyl anthranilate, spirogalbanone pure, and javanol.

In the detergent composition of the aforementioned first aspect or second aspect, the fragrance (A) is preferably composed of at least three fragrance components.

In the detergent composition of the aforementioned first aspect or second aspect, the amount of alkyl methyl ketones measured by the measurement method described below is preferably not more than 5.3 ng.

(Method for Measuring Amount of Alkyl Methyl Ketones)

Three grams of the detergent composition is weighed accurately and placed in a sealable container with a capacity of 20 mL, the container is sealed, and following standing for 30 minutes in a 40° C. thermostatic chamber, a solid-phase microextraction fiber is exposed for one hour at 40° C. within the head space portion inside the container, thereby extracting the alkyl methyl ketones having an alkyl group with a carbon number of 4 to 8 from the head space portion. Following this extraction, the solid-phase microextraction fiber is analyzed using a gas chromatography-mass spectrometry apparatus, the total amount (ng) of the aforementioned alkyl methyl ketones extracted from the head space portion is determined, and that value is deemed the amount of alkyl methyl ketones.

Effects of the Invention

The present invention is able to provide a detergent composition with a favorable aroma in which the effects of odors derived from α-sulfo fatty acid alkyl ester salts are suppressed.

BEST MODE FOR CARRYING OUT THE INVENTION

Detergent Composition of First Aspect

A detergent composition of the first aspect of the present invention (hereafter also referred to as the detergent composition (1)) contains an α-sulfo fatty acid alkyl ester salt and a fragrance composition.

<α-Sulfo Fatty Acid Alkyl Ester Salt>

The α-sulfo fatty acid alkyl ester salt is a type of anionic surfactant, and functions as a detergent component.

Examples of the α-sulfo fatty acid alkyl ester salt include compounds represented by general formula (I) shown below.

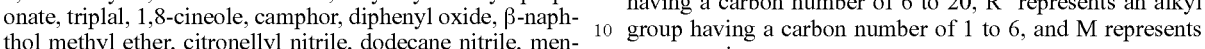

$$R^1—CH(SO_3M)-CO—O—R^2 \quad (I)$$

In the formula, $R^1$ represents an alkyl group or alkenyl group having a carbon number of 6 to 20, $R^2$ represents an alkyl group having a carbon number of 1 to 6, and M represents a counter ion.

The alkyl group or alkenyl group for $R^1$ may be linear or branched. From the viewpoint of the detergency, the carbon number of $R^1$ is typically from 6 to 20, preferably from 10 to 16, and more preferably from 14 to 16.

The alkyl group for $R^2$ may be linear or branched. From the viewpoint of the detergency, the carbon number of $R^2$ is typically from 1 to 6, preferably from 1 to 3, and most preferably 1. In other words, an α-sulfo fatty acid methyl ester (MES) salt is particularly preferred as the α-sulfo fatty acid alkyl ester salt.

The counter ion M may be any ion capable of forming a water-soluble salt with the $R^1CH(COOR^2)SO_3^-$ ion. Examples of this type of salt include alkali metal salts, alkaline earth metal salts, amine salts and ammonium salts.

Specific examples of the alkali metals include sodium and potassium.

Specific examples of the alkaline earth metals include calcium and magnesium.

The amine may be a primary, secondary or tertiary amine. Examples of the amine include alkanolamines, and the carbon number of the alkanol group is preferably from 1 to 3.

Specific examples of the alkanolamine include monoethanolamine, diethanolamine and triethanolamine.

The salt is preferably an alkali metal salt, and more preferably a sodium salt.

The detergent composition (1) may contain a single α-sulfo fatty acid alkyl ester salt or two or more α-sulfo fatty acid alkyl ester salts.

The amount of the α-sulfo fatty acid alkyl ester salt within the detergent composition (1), relative to the total mass of the detergent composition (1), is typically from 1 to 30% by mass, preferably from 4 to 30% by mass, more preferably from 8 to 30% by mass, and still more preferably from 8 to 20% by mass.

Provided that the amount of the α-sulfo fatty acid alkyl ester salt is at least 1% by mass, the effect of the α-sulfo fatty acid alkyl ester salt in improving the detergency performance can be enhanced, and provided the amount is not more than 30% by mass, the effects of the invention in suppressing the effects of the odors derived from the α-sulfo fatty acid alkyl ester salt on the aroma of the product (for example, the suppression effect on the unpleasantness resulting from odors derived from the α-sulfo fatty acid alkyl ester salt, and in the case where a fragrance (B) is also included in the detergent composition, the suppression effect on any inhibition by the aforementioned odors on the development of the aroma from the fragrance (B)) are more effective.

A commercially available product may be used as the α-sulfo fatty acid alkyl ester salt, or a salt produced using a conventional production method may be used.

An example of a commercially available α-sulfo fatty acid alkyl ester salt is the product MIZULAN manufactured by Lion Eco Chemicals Sdn. Bhd.

Examples of methods for producing α-sulfo fatty acid alkyl ester salts include the methods disclosed in International Patent Publication No. WO 2004-111166 pamphlet and International Patent Publication No. WO 2009-054406 pamphlet.

For example, an α-sulfo fatty acid alkyl ester can be obtained by sulfonating a fatty acid alkyl ester, and by neutralizing the sulfo group of the α-sulfo fatty acid alkyl ester with an alkali, an α-sulfo fatty acid alkyl ester salt is obtained. The alkali used in the neutralization corresponds with the aforementioned counter ion M.

In the above production method, if necessary, an esterification may be performed using an alcohol such as methanol, following the sulfonation but prior to the neutralization. If an esterification step is performed, then in those cases when $SO_3$ bimolecular adducts remain within the reaction product, the alkoxy portions of those $SO_3$ bimolecular adducts are esterified, thus accelerating $SO_3$ elimination. As a result, the production of by-products is suppressed, and the purity of the α-sulfo fatty acid alkyl ester within the reaction product improves.

In the production method described above, if necessary, a bleaching treatment using a bleaching agent such as hydrogen peroxide may be performed, either before or after the aforementioned neutralization step, in order to adjust the color tone of the α-sulfo fatty acid alkyl ester salt to a color close to white.

The product (for example, α-sulfo fatty acid alkyl ester salt) obtainable after neutralization or breaching treatment is in a paste state having a solid content of 50 to 80% by mass. If necessary, the product may be subjected to condensation treatment, powdering treatment and the like.

The paste-like α-sulfo fatty acid alkyl ester salt obtained in the manner described above typically contains, in addition to the α-sulfo fatty acid alkyl ester salt itself; α-sulfo fatty acid dialkali salts (such as salts in which $R^2$ in the general formula (s1) shown above is substituted with another counter ion M. Hereafter these salts are sometimes referred to as disalts). Further, the product may also contain trace amounts of other by-products (including organic substances such as methyl sulfate, ethyl sulfate, propyl sulfate, lower and intermediate carboxylic acids and esters thereof, ketones and aldehydes, and inorganic substances such as sodium sulfate). In the paste-like α-sulfo fatty acid alkyl ester salt, the amounts of the various components, relative to the total mass of the paste-like α-sulfo fatty acid alkyl ester salt, may typically include 40 to 80% by mass of the α-sulfo fatty acid alkyl ester salt (as a pure fraction), 0 to 3% by mass of a zeolite, 1 to 10% by mass of α-sulfo fatty acid dialkali salts, 1 to 10/o % by mass of methyl sulfate, 1 to 10% by mass of sodium sulfate, 10 to 40% by mass of moisture, and trace amounts of other by-products.

In those cases when a powdered α-sulfo fatty acid alkyl ester salt is to be used during production of the detergent composition, the paste-like α-sulfo fatty acid alkyl ester salt obtained from the above production method, or the α-sulfo fatty acid alkyl ester intermediate product, may be subjected to a powdering treatment.

Although there are no particular limitations on the method used for producing a powdered α-sulfo fatty acid alkyl ester salt, examples include the methods described below.

1. A method in which a paste-like α-sulfo fatty acid alkyl ester salt obtained in the manner described above is dissolved in a solvent such as water to form a slurry, and a drying step such as spray drying is then performed to form a powder.

2. A method in which the solvent fraction such as the methanol fraction of a paste-like α-sulfo fatty acid alkyl ester salt obtained in the manner described above is removed by flash distillation or the like, or the moisture fraction is evaporated to generate a concentrated state, and a granulation is then performed.

3. A method in which the moisture fraction of a paste-like α-sulfo fatty acid alkyl ester salt obtained in the manner described above is evaporated to generate a concentrated state, and a solid obtained by using a drum flaker or belt cooler or the like to cool the concentrated material is then pulverized or granulated.

4. A method in which an α-sulfo fatty acid alkyl ester obtained in the manner described above is neutralized while undergoing granulation with an alkali component.

The granulation can be performed using a conventional granulation method such as extrusion granulation, agitation granulation or rolling granulation.

<Fragrance Composition>

The fragrance composition contains a fragrance (A) described below.

Fragrance (A): a fragrance composed of at least one fragrance component selected from the group consisting of dihydromyrcenol, isobornyl acetate, α-hexyl cinnamic aldehyde, lilial, tetrahydrolinalool, amyl salicylate, verdox, vertenex, tricyclodecenyl acetate, tricyclodecenyl propionate, Iso E Super, and habanolide.

The fragrance component that constitutes the fragrance (A) may be one or more components selected from the above 12 components. In terms of achieving superior effects for the present invention, the fragrance (A) is preferably composed of at least 3 fragrance components from among the above 12 components.

The fragrance (A) preferably contains at least one fragrance component selected from the group consisting of dihydromyrcenol, isobornyl acetate, tricyclodecenyl acetate and tricyclodecenyl propionate.

The fragrance (A) preferably contains at least one fragrance component selected from the group consisting of α-hexyl cinnamic aldehyde, amyl salicylate, Iso E Super and habanolide.

The fragrance (A) preferably contains at least one fragrance component selected from the group consisting of lilial, tetrahydrolinalool, verdox and vertenex.

The fragrance (A) preferably contains a combination of at least one fragrance component selected from the group consisting of dihydromyrcenol, isobornyl acetate, tricyclodecenyl acetate and tricyclodecenyl propionate, and at least one fragrance component selected from the group consisting of α-hexyl cinnamic aldehyde, amyl salicylate, Iso E Super and habanolide. In such a case, the mass ratio between the at least one fragrance component selected from the group consisting of dihydromyrcenol, isobornyl acetate, tricyclodecenyl acetate and tricyclodecenyl propionate, and the at least one fragrance component selected from the group consisting of α-hexyl cinnamic aldehyde, amyl salicylate, Iso E Super and habanolide is preferably 1:1.

The fragrance (A) preferably contains a combination of at least one fragrance component selected from the group consisting of dihydromyrcenol, isobornyl acetate, tricyclodecenyl acetate and tricyclodecenyl propionate, and at least one fragrance component selected from the group consisting of lilial, tetrahydrolinalool, verdox and vertenex. In such a case, the mass ratio between the at least one fragrance component selected from the group consisting of dihydromyrcenol, isobornyl acetate, tricyclodecenyl acetate and tricyclodecenyl propionate, and the at least one fragrance component selected from the group consisting of lilial, tetrahydrolinalool, verdox and vertenex is preferably 1:1.

The fragrance (A) preferably contains a combination of at least one fragrance component selected from the group consisting of α-hexyl cinnamic aldehyde, amyl salicylate, Iso E Super and habanolide, and at least one fragrance component selected from the group consisting of lilial, tetrahydrolinalool, verdox and vertenex. In such a case, the mass ratio between the at least one fragrance component selected from the group consisting of α-hexyl cinnamic aldehyde, amyl salicylate, Iso E Super and habanolide, and the at least one fragrance component selected from the group consisting of lilial, tetrahydrolinalool, verdox and vertenex is preferably 1:1.

The fragrance (A) preferably contains a combination of at least one fragrance component selected from the group consisting of dihydromyrcenol, isobornyl acetate, tricyclodecenyl acetate and tricyclodecenyl propionate, at least one fragrance component selected from the group consisting of α-hexyl cinnamic aldehyde, amyl salicylate, Iso E Super and habanolide, and at least one fragrance component selected from the group consisting of lilial, tetrahydrolinalool, verdox and vertenex. In such a case, the mass ratio between the at least one fragrance component selected from the group consisting of dihydromyrcenol, isobornyl acetate, tricyclodecenyl acetate and tricyclodecenyl propionate, the at least one fragrance component selected from the group consisting of α-hexyl cinnamic aldehyde, amyl salicylate, Iso E Super and habanolide, and the at least one fragrance component selected from the group consisting of lilial, tetrahydrolinalool, verdox and vertenex is preferably 1:1:1.

The fragrance (A) is preferably a combination of dihydromyrcenol, isobornyl acetate, α-hexyl cinnamic aldehyde, lilial, tetrahydrolinalool, amyl salicylate, verdox, vertenex, tricyclodecenyl acetate, tricyclodecenyl propionate, Iso E Super and habanolide; a combination of dihydromyrcenol, verdox and habanolide; a combination of isobornyl acetate, tetrahydrolinalool and Iso E Super; a combination of amyl salicylate, vertenex and tricyclodecenyl propionate; a combination of α-hexyl cinnamic aldehyde, lilial and tricyclodecenyl acetate; a combination of α-hexyl cinnamic aldehyde, lilial and tricyclodecenyl propionate; a combination of lilial, amyl salicylate and tricyclodecenyl propionate; a combination of lilial, tricyclodecenyl propionate and Iso E Super; a combination of lilial, tricyclodecenyl propionate and habanolide; a combination of α-hexyl cinnamic aldehyde, tetrahydrolinalool and tricyclodecenyl propionate; a combination of tetrahydrolinalool, amyl salicylate and tricyclodecenyl propionate; a combination of tetrahydrolinalool, tricyclodecenyl propionate and Iso E Super; a combination of tetrahydrolinalool, tricyclodecenyl propionate and habanolide; a combination of α-hexyl cinnamic aldehyde, verdox and tricyclodecenyl propionate; a combination of amyl salicylate, verdox and tricyclodecenyl propionate; a combination of verdox, tricyclodecenyl propionate and Iso E Super; a combination of verdox, tricyclodecenyl propionate and habanolide; a combination of α-hexyl cinnamic aldehyde, verdox and tricyclodecenyl propionate; a combination of verdox, tricyclodecenyl propionate and Iso E Super, a combination of verdox, tricyclodecenyl propionate and habanolide; a combination of α-hexyl cinnamic aldehyde, vertenex and tricyclodecenyl propionate; a combination of vertenex, tricyclodecenyl propionate and Iso E Super; a combination of vertenex, tricyclodecenyl propionate and habanolide; a combination of lilial, amyl salicylate and tricyclodecenyl acetate; a combination of lilial, tricyclodecenyl acetate and Iso E Super; a combination of lilial, tricyclodecenyl acetate and habanolide; a combination of α-hexyl cinnamic aldehyde, tetrahydrolinalool and tricyclodecenyl acetate; a combination of tetrahydrolinalool, amyl salicylate and tricyclodecenyl acetate; a combination of tetrahydrolinalool, tricyclodecenyl acetate and Iso E Super; a combination of tetrahydrolinalool, tricyclodecenyl acetate and habanolide; a combination of α-hexyl cinnamic aldehyde, verdox and tricyclodecenyl acetate; a combination of amyl salicylate, verdox and tricyclodecenyl acetate; a combination of verdox, tricyclodecenyl acetate and Iso E Super; a combination of verdox, tricyclodecenyl acetate and habanolide; a combination of α-hexyl cinnamic aldehyde, vertenex and tricyclodecenyl acetate; a combination of amyl salicylate, vertenex and tricyclodecenyl acetate; a combination of vertenex, tricyclodecenyl acetate and Iso E Super; a combination of vertenex, tricyclodecenyl acetate and habanolide; a combination of isobornyl acetate, α-hexyl cinnamic aldehyde and lilial; a combination of isobornyl acetate, lilial and amyl salicylate; a combination of isobornyl acetate, lilial and Iso E Super; a combination of isobornyl acetate, lilial and habanolide; a combination of isobornyl acetate, α-hexyl cinnamic aldehyde and tetrahydrolinalool; a combination of isobornyl acetate, tetrahydrolinalool and amyl salicylate; a combination of isobornyl acetate, tetrahydrolinalool and habanolide; a combination of isobornyl acetate, α-hexyl cinnamic aldehyde and verdox; a combination of isobornyl acetate, amyl salicylate and verdox; a combination of isobornyl acetate, verdox and Iso E Super; a combination of isobornyl acetate, verdox and habanolide; a combination of isobornyl acetate, α-hexyl cinnamic aldehyde and vertenex; a combination of isobornyl acetate, amyl salicylate and vertenex; a combination of isobornyl acetate, vertenex and Iso E Super; a combination of isobornyl acetate, vertenex and habanolide; a combination of dihydromyrcenol, α-hexyl cinnamic aldehyde and lilial; a combination of dihydromyrcenol, lilial and amyl salicylate; a combination of dihydromyrcenol, lilial and Iso E Super; a combination of dihydromyrcenol, lilial and habanolide; a combination of dihydromyrcenol, α-hexyl cinnamic aldehyde and tetrahydrolinalool; a combination of dihydromyrcenol, tetrahydrolinalool and amyl salicylate; a combination of dihydromyrcenol, tetrahydrolinalool and Iso E Super; a combination of dihydromyrcenol, tetrahydrolinalool and habanolide; a combination of dihydromyrcenol, α-hexyl cinnamic aldehyde and habanolide; a combination of dihydromyrcenol, α-hexyl cinnamic aldehyde and verdox; a combination of dihydromyrcenol, amyl salicylate and verdox; a combination of dihydromyrcenol, verdox and Iso E Super; a combination of dihydromyrcenol, α-hexyl cinnamic aldehyde and vertenex; a combination of dihydromyrcenol, amyl salicylate and vertenex; a combination of dihydromyrcenol, vertenex and Iso E Super; or a combination of dihydromyrcenol, vertenex and habanolide.

The amount of the fragrance (A) in the detergent composition (1), relative to the total mass of the detergent composition (1), is typically from 0.07 to 0.5% by mass, preferably from 0.09 to 0.5% by mass, and more preferably from 0.21 to 0.5% by mass. By ensuring that the amount of the fragrance (A) in the detergent composition (1) is at least 0.07% by mass, any deterioration in the product aroma due to odors derived from the α-sulfo fatty acid alkyl ester salt is suppressed. Further, when the composition also contains the fragrance (B) described below, inhibition of the development of the aroma from the fragrance (B) due to the aforementioned odors is also suppressed. As a result, the aroma of the product is favorable.

In the present embodiment, there are no particular limitations on the amount of the fragrance (A) within the fragrance composition, provided that the amount of the fragrance (A) relative to the total mass of the detergent composition (1) falls within the range from 0.07 to 0.5% by mass.

The amount of the fragrance (A) within the fragrance composition, relative to the total mass of the fragrance composition, is typically at least 20% by mass, preferably at least 30% by mass, and more preferably 50% by mass or greater. More specifically, the amount is preferably from 70 to 90% by mass, and more preferably from 80 to 90% by mass.

Further, there are no particular limitations on the amount of the fragrance composition in the detergent composition (1), provided that the amount of the fragrance (A) relative to the total mass of the detergent composition (1) falls within the range from 0.07 to 0.5% by mass. Specifically, the amount of the fragrance composition relative to the total mass of the detergent composition (1) is typically from 0.25 to 1% by mass, preferably from 0.25 to 0.7% by mass, and more preferably from 0.25 to 0.5% by mass.

By ensuring that the amount of the fragrance composition in the detergent composition (1) is at least 0.25% by mass relative to the total mass of the detergent composition (1), and that the amount of the fragrance (A) within the fragrance composition is at least 20% by mass relative to the total mass of the fragrance composition, any deterioration in the product aroma due to odors derived from the α-sulfo fatty acid alkyl ester salt is suppressed. Further, when the composition also contains the fragrance (B), inhibition of the development of the aroma from the fragrance (B) due to the aforementioned odors is also suppressed. As a result, the aroma of the product is favorable.

The fragrance composition may, if required, include fragrance components other than the fragrance (A), and solvents and the like.

There are no particular limitations on the fragrance components other than the fragrance (A), and fragrances may be selected appropriately from known fragrances. Lists of fragrance raw materials that can be used are disclosed in various documents, including "Perfume and Flavor Chemicals", Vol. I and II, Steffen Arctander, Allured Pub. Co. (1994); "Gousei kouryou kagaku to shouhin chishiki" (Synthetic Fragrance Chemistry and Product Knowledge), Motoichi Indo, published by The Chemical Daily Co., Ltd. (1996); "Perfume and Flavor Materials of Natural Origin", Steffen Arctander, Allured Pub. Co. (1994); "Kaori no Hyakka" (Encyclopedia of Fragrances), edited by Japan Flavor and Fragrance Materials Association, Asakura Publishing Co., Ltd. (1989); "Perfumery Material Performance V.3.3", Boelens Aroma Chemical Information Service (1996); and "Flower oils and Floral Compounds In Perfumery", Danute Lajaujis Anonis, Allured Pub. Co. (1993).

The fragrance composition preferably contains the fragrance (B) described below as a fragrance component other than the fragrance (A). The fragrance (B) has a stronger aroma than the fragrance (A), and is used for imparting a distinctive aroma to the product.

The fragrance (A) itself is not a fragrance component with a particularly strong aroma, but including at least a certain amount of the fragrance (A) in the present invention enables the effects of the odors derived from the α-sulfo fatty acid alkyl ester salt to be suppressed. Accordingly, the development of the aroma of the fragrance (B) is more favorable than the case where the fragrance (A) is not included, making it easier to achieve the perfume effect provided by the fragrance (B).

Fragrance (B): a fragrance composed of at least one fragrance component selected from the group consisting of 3,7-dimethyl-2,6-nonadienenitrile, allyl cyclohexyl propionate, triplal, 1,8-cineole, camphor, diphenyl oxide, β-naphthol methyl ether, citronellyl nitrile, dodecane nitrile, menthone, ethyl 2-methylbutyrate, ethyl 2-methylvalerate, citronellal, patchouli oil, n-heptanal, n-octanal, n-nonanal, 1-decanal, undecanal, dodecanal, 2-methylundecanal, 10-undecenal, terpineol-4, menthol, styralyl acetate, butyl acetate, isoamyl acetate, prenyl acetate, hexyl acetate, cis-3-hexenyl acetate, allyl amyl glycolate, cis-3-hexenol, ethyl 2-cyclohexyl propionate, fruitate, allyl hexanoate, allyl heptanoate, ethyl hexanoate, ethyl heptanoate, isomenthone, isocyclocitral, octyl isobutyrate, benzaldehyde, anisaldehyde, 1,4-cineole, allyl ionone, floropal, linalool oxide, rose oxide, cyclogalbanate, α-dynascone, α-damascone, β-damascone, γ-damascone, δ-damascone, β-damascenone, methyl heptenone, L-carvone, geranial, neral, 4-methyl-3-decen-5-ol, methyl pamplemousse, 3-methyl-1-isobutylbutyl acetate, ethyl butyrate, cashmeran, karanal, cedrol methyl ether, 2,2,6-trimethylcyclohexyl-3-hexanol, methyl naphthyl ketone, methyl anthranilate, spirogalbanone pure, and javanol.

The fragrance component that constitutes the fragrance (B) may be one or more of the above components.

Among the above components, in order to achieve better aroma development, the fragrance component that constitutes the fragrance (B) is preferably at least one fragrance component selected from the group consisting of 3,7-dimethyl-2,6-nonadienenitrile, allyl cyclohexyl propionate, triplal, 1,8-cineole, camphor, diphenyl oxide, β-naphthol methyl ether, citronellyl nitrile, dodecane nitrile, menthone, ethyl 2-methylbutyrate, ethyl 2-methylvalerate, citronellal and patchouli oil. Among these, at least one fragrance component selected from the group consisting of allyl cyclohexyl propionate, 1,8-cineole, camphor, diphenyl oxide, β-naphthol methyl ether, citronellyl nitrile, menthone, citronellal, triplal, dodecane nitrile, 3,7-dimethyl-2,6-nonadienenitrile, ethyl 2-methylbutyrate, ethyl 2-methylvalerate and patchouli oil is more preferred. In particular, the fragrance (B) most preferably includes allyl cyclohexyl propionate, 1,8-cineole, camphor, diphenyl oxide, β-naphthol methyl ether, citronellyl nitrile, menthone, citronellal, triplal, dodecane nitrile, 3,7-dimethyl-2,6-nonadienenitrile, ethyl 2-methylbutyrate, ethyl 2-methylvalerate and patchouli oil.

In terms of the combination of the fragrance (A) and the fragrance (B), a combination of a fragrance (A) containing at least one fragrance component selected from the group consisting of dihydromyrcenol, isobornyl acetate, tricyclodecenyl acetate and tricyclodecenyl propionate, and a fragrance (B) containing at least one fragrance component selected from the group consisting of allyl cyclohexyl propionate, 1,8-cineole, camphor, diphenyl oxide, β-naphthol methyl ether, citronellyl nitrile, menthone, citronellal, triplal, dodecane nitrile, 3,7-dimethyl-2,6-nonadienenitrile, ethyl 2-methylbutyrate, ethyl 2-methylvalerate and patchouli oil is preferred. Further, a combination of a fragrance (A) containing at least one fragrance component selected from the group consisting of α-hexyl cinnamic aldehyde, amyl salicylate, Iso E Super and habanolide, and a fragrance (B) containing at least one fragrance component selected from the group consisting of allyl cyclohexyl propionate, 1,8-cineole, camphor, diphenyl oxide, β-naphthol methyl ether, citronellyl nitrile, menthone, citronellal, triplal, dodecane nitrile, 3,7-dimethyl-2,6-nonadienenitrile, ethyl 2-methylbutyrate, ethyl 2-methylvalerate and patchouli oil is also preferred.

Furthermore, a combination of a fragrance (A) containing at least one fragrance component selected from the group consisting of lilial, tetrahydrolinalool, verdox and vertenex, and a fragrance (B) containing at least one fragrance component selected from the group consisting of allyl cyclohexyl propionate, 1,8-cineole, camphor, diphenyl oxide, β-naphthol methyl ether, citronellyl nitrile, menthone, citronellal, triplal, dodecane nitrile, 3,7-dimethyl-2,6-nonadienenitrile, ethyl 2-methylbutyrate, ethyl 2-methylvalerate and patchouli oil is also preferred. Moreover, a combination of a fragrance (A) containing at least one fragrance component selected from the group consisting of dihydromyrcenol, isobornyl acetate, tricyclodecenyl acetate and tricyclodecenyl propionate, at least one fragrance component selected from the group consisting of α-hexyl cinnamic aldehyde, amyl salicylate, Iso E Super and habanolide, and at least one fragrance component selected from the group consisting of lilial, tetrahydrolinalool, verdox and vertenex, and a fragrance (B) containing at least one fragrance component selected from the group consisting of allyl cyclohexyl propionate, 1,8-cineole, camphor, diphenyl oxide, β-naphthol methyl ether, citronellyl nitrile, menthone, citronellal, triplal, dodecane nitrile, 3,7-dimethyl-2,6-nonadienenitrile, ethyl 2-methylbutyrate, ethyl 2-methylvalerate and patchouli oil is more preferred.

Further, a fragrance (A) composed of at least one combination selected from the group consisting of: a combination of dihydromyrcenol, isobornyl acetate, α-hexyl cinnamic aldehyde, lilial, tetrahydrolinalool, amyl salicylate, verdox, vertenex, tricyclodecenyl acetate, tricyclodecenyl propionate, Iso E Super and habanolide; a combination of dihydromyrcenol, verdox and habanolide; a combination of isobornyl acetate, tetrahydrolinalool and Iso E Super; a combination of amyl salicylate, vertenex and tricyclodecenyl propionate; a combination of α-hexyl cinnamic aldehyde, lilial and tricyclodecenyl acetate; a combination of α-hexyl cinnamic aldehyde, lilial and tricyclodecenyl propionate; a combination of lilial, amyl salicylate and tricyclodecenyl propionate; a combination of lilial, tricyclodecenyl propionate and Iso E Super; a combination of lilial, tricyclodecenyl propionate and habanolide; a combination of α-hexyl cinnamic aldehyde, tetrahydrolinalool and tricyclodecenyl propionate; a combination of tetrahydrolinalool, amyl salicylate and tricyclodecenyl propionate; a combination of tetrahydrolinalool, tricyclodecenyl propionate and Iso E Super; a combination of tetrahydrolinalool, tricyclodecenyl propionate and habanolide; a combination of α-hexyl cinnamic aldehyde, verdox and tricyclodecenyl propionate; a combination of amyl salicylate, verdox and tricyclodecenyl propionate; a combination of verdox, tricyclodecenyl propionate and Iso E Super; a combination of verdox, tricyclodecenyl propionate and habanolide; a combination of α-hexyl cinnamic aldehyde, verdox and tricyclodecenyl propionate; a combination of verdox, tricyclodecenyl propionate and Iso E Super; a combination of verdox, tricyclodecenyl propionate and habanolide; a combination of α-hexyl cinnamic aldehyde, vertenex and tricyclodecenyl propionate; a combination of vertenex, tricyclodecenyl propionate and Iso E Super; a combination of vertenex, tricyclodecenyl propionate and habanolide; a combination of lilial, amyl salicylate and tricyclodecenyl acetate; a combination of lilial, tricyclodecenyl acetate and Iso E Super, a combination of lilial, tricyclodecenyl acetate and habanolide; a combination of α-hexyl cinnamic aldehyde, tetrahydrolinalool and tricyclodecenyl acetate; a combination of tetrahydrolinalool, amyl salicylate and tricyclodecenyl acetate; a combination of tetrahydrolinalool, tricyclodecenyl acetate and Iso E Super; a combination of tetrahydrolinalool, tricyclodecenyl acetate and habanolide; a combination of α-hexyl cinnamic aldehyde, verdox and tricyclodecenyl acetate; a combination of amyl salicylate, verdox and tricyclodecenyl acetate; a combination of verdox, tricyclodecenyl acetate and Iso E Super; a combination of verdox, tricyclodecenyl acetate and habanolide; a combination of α-hexyl cinnamic aldehyde, vertenex and tricyclodecenyl acetate; a combination of amyl salicylate, vertenex and tricyclodecenyl acetate; a combination of vertenex, tricyclodecenyl acetate and Iso E Super; a combination of vertenex, tricyclodecenyl acetate and habanolide; a combination of isobornyl acetate, α-hexyl cinnamic aldehyde and lilial; a combination of isobornyl acetate, lilial and amyl salicylate; a combination of isobornyl acetate, lilial and Iso E Super; a combination of isobornyl acetate, lilial and habanolide; a combination of isobornyl acetate, α-hexyl cinnamic aldehyde and tetrahydrolinalool; a combination of isobornyl acetate, tetrahydrolinalool and amyl salicylate; a combination of isobornyl acetate, tetrahydrolinalool and habanolide; a combination of isobornyl acetate, α-hexyl cinnamic aldehyde and verdox; a combination of isobornyl acetate, amyl salicylate and verdox; a combination of isobornyl acetate, verdox and Iso E Super; a combination of isobornyl acetate, verdox and habanolide; a combination of isobornyl acetate, α-hexyl cinnamic aldehyde and vertenex; a combination of isobornyl acetate, amyl salicylate and vertenex; a combination of isobornyl acetate, vertenex and Iso E Super; a combination of isobornyl acetate, vertenex and habanolide; a combination of dihydromyrcenol, α-hexyl cinnamic aldehyde and lilial; a combination of dihydromyrcenol, lilial and amyl salicylate; a combination of dihydromyrcenol, lilial and Iso E Super; a combination of dihydromyrcenol, lilial and habanolide; a combination of dihydromyrcenol, α-hexyl cinnamic aldehyde and tetrahydrolinalool; a combination of dihydromyrcenol, tetrahydrolinalool and amyl salicylate; a combination of dihydromyrcenol, tetrahydrolinalool and Iso E Super; a combination of dihydromyrcenol, tetrahydrolinalool and habanolide; a combination of dihydromyrcenol, α-hexyl cinnamic aldehyde and habanolide; a combination of dihydromyrcenol, α-hexyl cinnamic aldehyde and verdox; a combination of dihydromyrcenol, amyl salicylate and verdox; a combination of dihydromyrcenol, verdox and Iso E Super; a combination of dihydromyrcenol, α-hexyl cinnamic aldehyde and vertenex; a combination of dihydromyrcenol, amyl salicylate and vertenex; a combination of dihydromyrcenol, vertenex and Iso E Super; and a combination of dihydromyrcenol, vertenex and habanolide, and a fragrance (B) composed of allyl cyclohexyl propionate, 1,8-cineole, camphor, diphenyl oxide, β-naphthol methyl ether, citronellyl nitrile, menthone, citronellal, triplal, dodecane nitrile, 3,7-dimethyl-2,6-nonadienenitrile, ethyl 2-methylbutyrate, ethyl 2-methylvalerate and patchouli oil is particularly preferred.

When the fragrance composition includes the fragrance (B), the amount of the fragrance (B) within the fragrance composition is an amount that results in a mass ratio of the fragrance (A) relative to the fragrance (B), represented by (mass of fragrance (A))/(mass of fragrance (B)) (hereafter also referred to as A/B), that is at least 1 but not more than 10. In other words, the amount of the fragrance (B) relative to 100 parts by mass of the fragrance (A) is at least 10 parts by mass but not more than 100 parts by mass. A/B is preferably at least 1 but not more than 9, and more preferably at least 1 but not more than 7.

The value of A/B in the fragrance composition is the same as the value of A/B in the detergent composition (1).

The variety and amounts of the fragrance components in the detergent composition can be determined by adjusting the variety and amounts of the raw materials used during production. Alternatively, the variety and amounts of the fragrance components may be confirmed by analyzing the detergent composition following production.

Analysis of the detergent composition (analysis of the variety and amounts of the components in the fragrances (A) and (B)) can be performed using typical methods. For example, in the case of a granular detergent composition, analysis of the fragrance components of the fragrances (A) and (B) and the like may be performed by liquid extraction, using the procedure outlined below. In the method described below, quantification is performed using an internal standard. Any substance having a (peak) retention time that does not overlap with those of the fragrance components can be used as the internal standard, and examples include hydrocarbons such as n-tetradecane.

[Method for Analyzing Fragrance Components in Granular Detergent Compositions]

1. One gram of the granular detergent composition is weighed accurately into a vial with a capacity of 20 mL, and a mixed solution of diethyl ether/acetone=9/1 (volumetric ratio) (1 mL) containing n-tetradecane at a concentration of 100 ppm as an internal standard is added to the vial.

2. Subsequently, water (5 mL) and a mixed solution of diethyl ether/acetone=9/1 (volumetric ratio) (5 mL) are added to the vial, and following mixing using a vortex mixer, the supernatant is transferred to a measuring flask (capacity: 20 mL).

3. The operations described above in 2 are repeated twice, the supernatant that has been transferred to the measuring flask is made up to a constant volume with a mixed solution of diethyl ether/acetone=9/1 (volumetric ratio) (although being an internal standard method, a constant volume is not essential), an appropriate amount of sodium sulfate is added and shaken, and following standing for 10 minutes, the supernatant is filtered through a filter with a pore size of 0.45 μm to obtain a test solution.

4. The obtained test solution is analyzed using a GC-MS (Agilent 7890/5975C, manufactured by Agilent Technologies, Inc.) and an HP-INNOWax column (length: 30 m, inner diameter: 0.25 mm, film thickness: 0.25 μm), under conditions including a measurement temperature that is held at 35° C. for 3 minutes, increased to 205° C. at a rate of 4° C./minute, and then further increased to 250° C. at 10° C./minute, helium as the carrier gas, an injection temperature of 250° C., an interface temperature of 250° C., and a splitless injection method.

5. Based on the results from 4 above, and using the peak area values in the mass chromatogram, the internal standard method is used to quantify the fragrance components (such as the fragrance components that constitute the fragrance (A)) in the test solution. Based on the resulting values and the weight of the weighed granular detergent composition, the amount (%) of the fragrance (A) can be calculated as a weight percentage of the total of all the fragrance components that constitute the fragrance (A) per unit of weight of the granular detergent composition. The amount (%) of the fragrance (B) can be calculated in a similar manner.

There are no particular limitations on the solvent for the fragrance composition, and solvents commonly known as solvents for fragrance components may be used. Specific examples include the same solvents as those listed below as examples of optional components. Among these solvents, ethanol, isopropanol, glycerol, ethylene glycol, propylene glycol, diethylene glycol and dipropylene glycol are preferred. The amount of the solvent in the fragrance composition, relative to the total mass of the fragrance composition, is preferably from 40 to 80% by mass, and more preferably from 50 to 70% by mass.

There are no particular limitations on the amount of the fragrance composition in the detergent composition (1), provided that the amount of the fragrance (A) falls within the range described above.

<Optional Components>

The detergent composition (1) may, if required, include other components besides the α-sulfo fatty acid alkyl ester salt and the fragrance composition. Examples of these other components include surfactants other than α-sulfo fatty acid alkyl ester salts, detergency builders, colorants, fluorescent brighteners, bleaching agents, bleach activators, bleach activation catalysts, enzymes, enzyme stabilizers, polymers, caking inhibitors, anti-foaming agents, reducing agents, clay minerals, fiber-treating silicone compounds, ultraviolet absorbers, pH modifiers, antioxidants, preservatives and process agents. Further, if necessary the detergent composition may also include liquid media such as water or solvents.

[Surfactants]

Examples of the surfactants other than α-sulfo fatty acid alkyl ester salts include anionic surfactants besides α-sulfo fatty acid alkyl ester salts, nonionic surfactants, cationic surfactants and amphoteric surfactants.

(Anionic Surfactants)

Examples of the anionic surfactants besides α-sulfo fatty acid alkyl ester salts include the types of compounds described below.

(1) Linear or branched alkylbenzene sulfonates having an alkyl group with a carbon number of 8 to 18 (hereafter also abbreviated as "LAS" or "ABS").

(2) Alkane sulfonates having a carbon number of 10 to 20.

(3) α-olefin sulfonates having a carbon number of 10 to 20 (hereafter also abbreviated as "AOS").

(4) Alkyl sulfates or alkenyl sulfates having a carbon number of 10 to 20 (hereafter also abbreviated as "AS").

(5) Alkyl (or alkenyl) ether sulfates having a linear or branched alkyl (or alkenyl) group with a carbon number of 10 to 20, to which has been added an average of 0.5 to 10 mol of any alkylene oxide having a carbon number of 2 to 4, or a mixture of ethylene oxide and propylene oxide (in which the molar ratio between EO and PO satisfies EO/PO=0.1/9.9 to 9.9/0.1) (hereafter also abbreviated as "AES").

(6) Alkyl (or alkenyl) phenyl ether sulfates having a linear or branched alkyl group (or alkenyl group) with a carbon number of 10 to 20, to which has been added an average of 3 to 30 mol of any alkylene oxide having a carbon number of 2 to 4, or a mixture of ethylene oxide (hereafter also abbreviated as "EO") and propylene oxide (hereafter also abbreviated as "PO") (in which the molar ratio between EO and PO satisfies EO/PO=0.1/9.9 to 9.9/0.1).

(7) Alkyl (or alkenyl) ether carboxylates having a linear or branched alkyl group (or alkenyl group) with a carbon number of 10 to 20, to which has been added an average of 0.5 to 10 mol of any alkylene oxide having a carbon number of 2 to 4, or a mixture of ethylene oxide and propylene oxide (in which the molar ratio between EO and PO satisfies EO/PO=0.1/9.9 to 9.9/0.1).

(8) Alkyl polyhydric alcohol ether sulfates such as alkyl glyceryl ether sulfonates having a carbon number of 10 to 20.

(9) Long-chain monoalkyl, dialkyl or sesquialkyl phosphates.

(10) Polyoxyethylene monoalkyl, dialkyl or sesquialkyl phosphates.

(11) Soaps.

Examples of the soaps include alkali metal salts, and preferably sodium or potassium salts, of fatty acids having an average carbon number of 10 to 20, and preferably higher fatty acids having a carbon number of 12 to 18. The alkyl chain of the fatty acid is preferably linear. In terms of the chain length, soaps of a single chain length and soaps composed of a mixture containing two or more different chain lengths can both be used favorably. These anionic surfactants can be used in the form of alkali metal salts such as sodium and potassium salts, amine salts, and ammonium salts and the like. Further, these anionic surfactants can be used in the form of mixtures.

(Nonionic Surfactants)

Examples of the nonionic surfactants include the compounds described below.

(1) Nonionic surfactants represented by general formula (n1) shown below.

$$R^3\text{-}T\text{-}[(R^4O)_p\text{—}R^5]_q \quad \text{(n1)}$$

In the formula, $R^3$ represents a hydrocarbon group having a carbon number of 6 to 22, and preferably an alkyl group or alkenyl group having a carbon number of 8 to 18, and more preferably 12 to 16.

$R^4$ represents an alkylene group having a carbon number of 2 to 4, and is preferably an ethylene group.

$R^5$ represents an alkylene group having a carbon number of 1 to 3 or a hydrogen atom, and is preferably a hydrogen atom.

Further, p represents the average number of repeating units of $R^4O$ (the average number of added moles of the alkylene oxide), and is number from 1 to 30, preferably a number from 3 to 25, and most preferably a number from 5 to 20.

T represents —O—, —N—, —NH—, —N($C_2H_4OH$)—, —COO—, —CON—, —CONH— or —CON($C_2H_4OH$)—, and when T represents —O—, —NH—, —N($C_2H_4OH$)—, —COO—, —CONH— or —CON($C_2H_4OH$)—, q is 1, whereas when T represents —N— or —CON—, q is 2.

Preferred examples of the nonionic surfactants represented by the above general formula (n1) include compounds represented by general formula (n1-1) shown below.

$$R^3\text{—}O\text{—}(C_2H_4O)_s(C_3H_6O)_t(C_2H_4O)\text{—}R^5 \quad \text{(n1-1)}$$

In the formula, $R^3$ and $R^5$ have the same meaning as defined above.

Further, s and u each represents the average number of repeating units of an oxyethylene group (the average number of added moles of ethylene oxide), wherein s is a number from 2 to 25, and preferably from 5 to 20, and u is a number from 0 to 5.

Moreover, t represents the average number of repeating units of an oxypropylene group (the average number of added moles of propylene oxide), and is a number from 0 to 5.

In the formula (n1-1), in the partial structure represented by $(C_2H_4O)_s(C_3H_6O)_t(C_2H_4O)_u$, the ($C_2H_4O$) groups and the ($C_3H_6O$) groups may be added randomly or in blocks.

Among the above nonionic surfactants, preferred compounds include polyoxyethylene alkyl ethers, polyoxyethylene alkenyl ethers, polyoxyethylene polyoxypropylene alkyl ethers, and polyoxyethylene polyoxypropylene alkenyl ethers.

The aliphatic alcohol used in these compounds may be a primary alcohol or a secondary alcohol, but is preferably a primary alcohol. Further, the alkyl group or alkenyl group may be either linear or branched.

For example, a polyoxyethylene alkyl ether having one or more alkyl groups or alkenyl groups with a carbon number of 12 to 18 is preferable, and compounds in which an average of 5 to 20 mol of oxyethylene groups have been added are particularly desirable.

(2) Polyoxyethylene alkyl phenyl ethers or polyoxyethylene alkenyl phenyl ethers.

(3) Glycerol fatty acid esters.

(4) Polyoxyethylene sorbitan fatty acid esters.

(5) Polyoxyethylene sorbit fatty acid esters.

(6) Polyoxyethylene fatty acid esters.

(7) Polyoxyethylene hardened castor oil.

These nonionic surfactants may be used individually, or appropriate combinations containing two or more compounds may be used.

Among the nonionic surfactants described above, nonionic surfactants of type (1) are preferred, and polyoxyethylene alkyl ethers, polyoxyethylene alkenyl ethers, polyoxyethylene polyoxypropylene alkyl ethers, polyoxyethylene polyoxypropylene alkenyl ethers, fatty acid methyl ester ethoxylates obtained by adding ethylene oxide to a fatty acid methyl ester and fatty acid methyl ester ethoxypropxylates obtained by adding ethylene oxide and propylene oxide to a fatty acid methyl ester, which have a melting point of 50° C. or lower and an HLB value of 9 to 16 can be used particularly favorably.

The "HLB value" mentioned above is a value determined by the Griffin method (see "New Edition Surfactant Handbook", co-edited by Yoshida, Shindo, Ogaki and Yamanaka, published by Kogyo-Tosho Co., Ltd., 1991, page 234).

Furthermore, the "melting point" mentioned above means a value measured by the melting point measurement method described in JIS K 0064-1992 "Measurement methods for melting points and melting ranges of chemical products."

(Cationic Surfactants)

Examples of the cationic surfactants include the compounds described below.

(1) Di(long-chain alkyl) di(short-chain alkyl) quaternary ammonium salts.

(2) Mono(long-chain alkyl) tri(short-chain alkyl) quaternary ammonium salts.

(3) Tri(long-chain alkyl) mono(short-chain alkyl) quaternary ammonium salts.

The term "long-chain alkyl" describes an alkyl group, or an alkenyl group having one or more double bonds, with a total carbon number of 12 to 26, and preferably 14 to 18, which may be divided by an ester group and/or an amide group.

The term "short-chain alkyl" includes substituents such as a phenyl group, benzyl group, hydroxyl group and hydroxyalkyl groups, and may also include an ether linkage between carbon atoms. Of the various possibilities, preferred groups include an alkyl group having a carbon number of 1 to 4, and preferably 1 or 2, a benzyl group, a hydroxyalkyl group having a carbon number of 2 to 4, and preferably 2 or 3, or a polyoxyalkylene group having a carbon number of 2 to 4, and preferably 2 or 3.

The above cationic surfactants may be used individually, or appropriate combinations containing two or more compounds may be used.

(Amphoteric Surfactants)

Examples of the amphoteric surfactants include imidazoline-based amphoteric surfactants and amidobetaine-based amphoteric surfactants. Specific examples of preferred amphoteric surfactants include 2-alkyl-N-carboxymethyl-N-hydroxyethylimidazolinium betaine and lauric acid amidopropylbetaine.

The amount of these surfactants in the detergent composition (1), relative to the total mass of the detergent composition (1), is preferably from 10 to 40% by mass, and more preferably from 10 to 30% by mass.

[Detergency Builders]

Examples of detergent builders include inorganic builders and organic builders.

Examples of the inorganic builders include alkali metal carbonates such as sodium carbonate, potassium carbonate, sodium bicarbonate and sodium sesquicarbonate; alkali metal sulfites such as sodium sulfite and potassium sulfite; crystalline layered sodium silicate [for example, crystalline alkali metal silicates such as the product "Na-SKS-6" ($\delta$-$Na_2O_2SiO_2$) manufactured by Clariant Japan K.K.] and amorphous alkali metal silicates; sulfates such as sodium sulfate and potassium sulfate; amorphous alkali metal silicates such as sodium silicate; alkali metal chlorides such as sodium chloride and potassium chloride; phosphates such as orthophosphates, pyrophosphates, tripolyphosphates, metaphosphates, hexametaphosphates and phytates; crystalline aluminosilicates and amorphous aluminosilicates; and complexes of sodium carbonate and amorphous alkali metal silicates (such as the product "NABION 15" manufactured by Rhodia Group).

Among the inorganic builders listed above, sodium carbonate, an aluminosilicate, or a potassium salt (such as potassium carbonate or potassium sulfate) or alkali metal chloride (such as potassium chloride or sodium chloride) which also provides a solubility improvement effect is preferable.

Either a crystalline or non-crystalline (amorphous) aluminosilicate may be used, but from the viewpoint of the cation exchange capability, a crystalline aluminosilicate is preferred.

A-type, X-type, Y-type and $\beta$-type zeolites and the like can be used favorably as the crystalline aluminosilicate.

The average primary particle size of the crystalline aluminosilicate is preferably from 0.1 to 10 μm. The average primary particle size can be measured by normal methods using a dynamic light-scattering particle size distribution analyzer SALD 2300 (manufactured by Shimadzu Corporation).

Examples of the organic builders include aminocarboxylates such as nitrilotriacetates (NTA), ethylenediaminetetraacetates (EDTA), $\beta$-alaninediacetates (ADAA), aspartic acid diacetates (ASDA), methylglycinediacetates (MGDA) and iminodisuccinates (IDS); hydroxyaminocarboxylates such as serine diacetates, hydroxyiminodisuccinates (HIDS), hydroxyethylethylenediaminetriacetates and dihydroxyethylglycine salts; hydroxycarboxylates such as hydroxyacetates, tartrates, citrates and gluconates; cyclocarboxylates such as pyromellitates, benzopolycarboxylates and cyclopentanetetracarboxylates; ether carboxylates such as a carboxymethyltartronates, carboxymethyloxysuccinates, oxydisuccinates and tartaric acid mono- or disuccinates; polyacetal carboxylates such as polyacrylates, acrylic acid-allyl alcohol copolymer salts, acrylic acid-maleic acid copolymer salts and polyglyoxylates; salts of acrylic acid polymers or copolymers such as hydroxyacrylic acid polymers and polysaccharide-acrylic acid copolymers; salts of polymers or copolymers of maleic acid, itaconic acid, fumaric acid, tetramethylene 1,2-dicarboxylic acid, succinic acid and aspartic acid and the like; and polysaccharide derivatives including polysaccharide oxides such as starch, cellulose, amylose and pectin.

Among the organic builders listed above, citrates, aminocarboxylates, hydroxyaminocarboxylates, polyacrylates, salts of acrylic acid-maleic acid copolymers, and polyacetal carboxylates are preferred. In particular, hydroxyiminodisuccinates, salts of acrylic acid-maleic acid copolymers having a weight-average molecular weight of 1,000 to 80,000, polyacrylates, and polyacetal carboxylates such as polyglyoxylates having a weight-average molecular weight of 800 to 1,000,000 (and preferably 5,000 to 200,000) (for example, the compounds disclosed in Japanese Unexamined Patent Application, First Publication No. Sho 54-52196) are ideal.

The above detergency builders may be used individually, or appropriate combinations containing two or more compounds may be used.

The amount of the detergency builder in the detergent composition (1), relative to the total mass of the detergent composition (1), is preferably from 10 to 40% by mass, and more preferably from 10 to 30% by mass.

[Colorants]

Various colorants may be used, including dyes and pigments.

Examples of dyes that may be used, classified in terms of their chemical structure, include azo dyes, anthraquinone dyes, indigoid dyes, phthalocyanine dyes, carbonium dyes, quinoneimine dyes, methine dyes, quinoline dyes, nitro dyes, nitroso dyes, benzoquinone and naphthoquinone dyes, naphthalimide dyes and perinone dyes. Further, oxides may also be used as colorants, including titanium oxide, iron oxide, copper phthalocyanine, cobalt phthalocyanine, ultramarine, Prussian blue, cyanine blue and cyanine green. These colorants may be used individually, or in mixtures containing two or more colorants.

The amount of the colorant in the detergent composition (1), relative to the total mass of the detergent composition (1), is preferably from 0.0001 to 0.1% by mass, and more preferably from 0.001 to 0.01% by mass.

[Fluorescent Brighteners]

Examples of the fluorescent brighteners include stilbene, pyrazoline, coumarin, carboxylic acids, methinecyanine, dibenzothiophene-5,5-dioxide, azole, and 5-membered and 6-membered heterocyclic compounds. Further examples include 4,4'-bis-(2-sulfostyryl)-biphenyl salts, 4,4'-bis(4-chloro-3-sulfostyryl)-biphenyl salts, 2-(styrylphenyl)naphthothiazole derivatives, 4,4'-bis(triazol-2-yl)stilbene derivatives and bis-(triazinylaminostilbene)disulfonic acid derivatives.

These fluorescent brighteners may be used individually, or appropriate combinations containing two or more compounds may be used.

Specific examples of preferred commercially available fluorescent brighteners include Whitex SA and Whitex SKC (both product names, manufactured by Sumitomo Chemical Co., Ltd.), Tinopal AMS-GX, Tinopal DBS-X and Tinopal CBS-X (all product names, manufactured by Ciba-Geigy Japan Ltd.), and Lemonite CBUS-3B (a product name, manufactured by Khyati Chemicals Pvt. Ltd.). Among these, Tinopal CBS-X and Tinopal AMS-GX are particularly preferred.

The amount of the fluorescent brightener in the detergent composition (1), relative to the total mass of the detergent composition (1), is preferably from 0.01 to 1% by mass, and more preferably from 0.04 to 0.4% by mass.

[Bleaching Agents]

There are no particular limitations on the bleaching agents, and any of the bleaching agents used in typical detergent compositions can be used favorably, but examples of compounds which can be used particularly favorably include inorganic peroxides and organic peroxides, which generate hydrogen peroxide when dissolved in water. Specific examples include alkali metal salts of percarbonic acid, perboric acid, peroxypyrophosphate, citrate perhydrate, perbenzoate, peroxyphthalate, diperazelaic acid, phthaloimino peracid and diperdodecanedioic acid. Usually, one or both of sodium percarbonate and sodium perborate is used. In terms of stability over time, sodium percarbonate is particularly preferred. If moisture or other detergent components or the like contact the surface of an inorganic peroxide particle, then the inorganic peroxide may sometimes undergo decomposition, and therefore in order to prevent such decomposition, the inorganic peroxide is preferably subjected to a coating treatment or the like. Oxygen-based bleaching agent particles that have already been proposed can be used as these coated particles. Examples include the bleaching agent particles disclosed in Japanese Patent (Granted) Publication No. 2,918,991. These bleaching agent particles exist in the form of granules obtained by separately spraying an aqueous solution of boric acid and an aqueous solution of an alkali metal silicate onto sodium percarbonate particles in a fluid state, and then drying the coated particles. In addition, conventional stabilizers such as chelating agents may also be used in combination with the coating agent.

The amount of the bleaching agent in the detergent composition (1), relative to the total mass of the detergent composition (1), is preferably from 1 to 20% by mass, and more preferably from 3 to 10% by mass.

[Bleach Activators, Bleach Activation Catalysts]

Conventional compounds may be used as the bleach activator, and the use of organic peracid precursors is preferred.

Examples of organic peracid precursors include tetraacetylethylenediamine, alkanoyloxy-benzenesulfonic acids or salts thereof having an alkanoyl group with a carbon number of 1 to 18, and preferably 8 to 12, and alkanoyloxybenzoic acids or salts thereof having an alkanoyl group with a carbon number of 1 to 18, and preferably 8 to 12, and among these compounds, 4-decanoyloxy-benzoic acid (DOBA), sodium 4-decanoyloxy-benzenesulfonate (DOBS) and sodium 4-nonanoyloxy-benzenesulfonate (NOBS) are preferred. These compounds may be used individually, or appropriate combinations containing two or more compounds may be used.

Particles containing bleach activators can be produced by conventional production methods. For example, production can be performed by an extrusion granulation method, or a granulation method with a prescribed tablet shape using a briquetting machine. Specifically, the organic peracid precursor particles are preferably obtained by dispersing the organic peracid precursor and a surfactant powder such as an olefin sulfonate, alkylbenzene sulfonate, or alkyl sulfate ester salt or the like in a heated and melted binder material that is solid at normal temperatures, such as a PEG #3000 to #20,000 polyethylene glycol and preferably a PEG #4000 to PEG #6000 polyethylene glycol, subsequently extruding the resulting dispersion to produce noodle-like organic peracid precursor granules having a diameter of about 1 mm, and then gently grinding the noodle-like granules into lengths of about 0.5 to 3 mm. The surfactant powder is preferably an α-olefin sulfonate with an alkyl chain length of 14.

Conventional compounds may be used as the bleach activation catalysts. Specific examples include compounds in which a transition metal atom such as copper, iron, manganese, nickel, cobalt, chromium, vanadium, ruthenium, rhodium, palladium, rhenium, tungsten or molybdenum, and one or more ligands form a complex via nitrogen atoms or oxygen atoms or the like. The transition metal is preferably cobalt or manganese or the like, and is most preferably manganese. The bleach activation catalysts disclosed in Japanese Unexamined Patent Application, First Publication No. 2004-189893 are particularly desirable.

Particles containing the bleach activation catalyst can be produced using conventional granulation methods. For example, production can be performed by an extrusion granulation method, or a granulation method with a prescribed tablet shape using a briquetting machine.

The amount of the bleach activator or bleach activation catalyst in the detergent composition (1), relative to the total mass of the detergent composition (1), is preferably from 0.1 to 5% by mass, and more preferably from 0.2 to 3% by mass.

[Enzymes]

Enzymes such as proteases, esterases, lipases, cellulases, amylases, pectinases, and glucosidases and the like are preferred as enzymes.

Specific examples of the proteases include pepsin, trypsin, chymotrypsin, collagenase, keratinase, elastase, subtilisin, papain, bromelin, carboxypeptidase A or B, aminopeptidase, and aspergillo-peptidase A or B. Examples of commercially available proteases include Savinase, Alcalase, Kannase, Everlase and Deozyme (all product names, manufactured by Novozymes Japan Ltd.); API 21 (a product name, manufactured by Showa Denko K.K.); Maxacal and Maxapem (both product names, manufactured by Genencor International BV); and Protease K-14 and K-16 (proteases disclosed in Japanese Unexamined Patent Application, First Publication No. Hei 5-25492).

Specific examples of the esterases include gastric lipase, pancreatic lipase, plant lipases, phospholipases, cholinesterases and phosphatases.

Specific examples of the lipases include commercially available lipases such as Lipolase and Lipex (both product names, manufactured by Novozymes Japan Ltd.), and Liposam (a product name, manufactured by Showa Denko K.K.).

Specific examples of the cellulases include commercially available products such as Celluclean and Celluzyme (product names, manufactured by Novozymes Japan Ltd.); and Alkali Cellulase K, Alkali Cellulase K-344, Alkali Cellulase K-534, Alkali Cellulase K-539, Alkali Cellulase K-577, Alkali Cellulase K-425, Alkali Cellulase K-521, Alkali Cellulase K-580, Alkali Cellulase K-588, Alkali Cellulase K-597, Alkali Cellulase K-522, CMC-ase I, CMC-ase II, Alkali Cellulase E-II and Alkali Cellulase E-III (all of which are cellulases disclosed in Japanese Unexamined Patent Application, First Publication No. Sho 63-264699).

Examples of the amylases include commercially available products such as Stainzyme, Termamyl and Duramyl (manufactured by Novozymes Japan Ltd.).

The above enzymes may be used individually, or appropriate combinations containing two or more enzymes may be used.

The enzymes are preferably used by dry blending stable particles of the enzyme that have been prepared separately with the detergent base (particles).

The amount of enzymes in the detergent composition (1), relative to the total mass of the detergent composition (1), is preferably from 0.01 to 2% by mass, and more preferably from 0.1 to 1% by mass.

[Enzyme Stabilizers]

Examples of enzyme stabilizers that may be added include calcium salts, magnesium salts, polyols, formic acid and boron compounds. Among these compounds, sodium tetraborate and calcium chloride are preferred.

The enzyme stabilizers may be used individually, or appropriate combinations containing two or more compounds may be used.

The amount of the enzyme stabilizer in the detergent composition (1), relative to the total mass of the detergent composition (1), is preferably from 0.01 to 1% by mass, and more preferably from 0.05 to 0.5% by mass.

[Polymers]

In the detergent composition, a polyethylene glycol with a weight-average molecular weight of 200 to 200,000, a salt of an acrylic acid and/or maleic acid polymer having a weight-average molecular weight of 1,000 to 100,000, a polyvinyl alcohol, a cellulose derivative such as a carboxymethyl cellulose (CMC), hydroxypropyl methyl cellulose (HPMC) or cationized cellulose, having a weight-average molecular weight of 2,000 to 1,000,000 and a degree of etherification of 0.2 to 1.0, or a cellulose such as a powdered cellulose may be added, either as a binder or powder properties regulator that is used when the density of the granular detergent composition is increased, or in order to impart an anti-resoiling effect relative to hydrophobic microparticles (soiling). The aforementioned weight-average molecular weights can be measured using a light scattering detector.

Further, a copolymer or terpolymer composed of a repeating unit derived from terephthalic acid and a repeating unit derived from ethylene glycol and/or propylene glycol may also be added as a soil removing agent.

Furthermore, polyvinylpyrrolidone, a polyamine N-oxide-containing polymer, a copolymer of N-vinylpyrrolidone and N-vinylimidazole, or poly(4-vinylpyridine-N-oxide) or the like may be added in order to impart a color migration preventative effect.

The above polymers may be used individually, or appropriate combinations containing two or more polymers may be used.

The amount of polymers in the detergent composition (1), relative to the total mass of the detergent composition (1), is preferably from 0.1 to 10% by mass, and more preferably from 0.5 to 5% by mass.

[Caking Inhibitors]

Caking inhibitors such as para-toluene sulfonates, xylene sulfonates, cumene sulfonates, acetates, sulfosuccinates, talc, finely powdered silica, clay and magnesium chloride may also be added.

The amount of the caking inhibitor in the detergent composition (1), relative to the total mass of the detergent composition (1), is preferably from 0.1 to 5% by mass, and more preferably from 0.1 to 3% by mass.

[Anti-Foaming Agents]

Examples of anti-foaming agents include conventional agents such as silicone/silica-based anti-foaming agents. Further, these anti-foaming agents may be used in the form of anti-foaming agent granules obtained using the production method described below.

First, 20 g of silicone ("PS Antifoam", a product name for a compound-type silicone manufactured by Dow Corning Corporation) as an anti-foaming agent component is added to 100 g of maltodextrin (a product name for an enzyme-modified dextrin manufactured by Nippon Starch Chemical Co., Ltd.) and mixed to obtain a uniform mixture. Subsequently, 50% by mass of the thus obtained uniform mixture, 25% by mass of polyethylene glycol (PEG-6000, melting point: 58° C.) and 25% by mass of neutral anhydrous sodium sulfate are mixed at 70 to 80° C., and the mixture is granulated using an extrusion granulator (model: EXKS-1, manufactured by Fuji Paudal Co., Ltd.) to obtain anti-foaming agent granules (see Japanese Unexamined Patent Application, First Publication No. Hei 3-186307).

The amount of the anti-foaming agent in the detergent composition (1), relative to the total mass of the detergent composition (1), is preferably from 0.1 to 5% by mass, and more preferably from 0.2 to 2% by mass.

[Reducing Agents]

Examples of reducing agents that may be used include sodium sulfite and potassium sulfite.

[Clay Minerals]

Clay minerals are used for the purpose of imparting softness to laundered textile products. Examples of these clay minerals include bentonite and the like.

The clay minerals may be used individually, or appropriate combinations containing two or more compounds may be used.

The amount of the clay minerals in the detergent composition (1), relative to the total mass of the detergent composition (1), is preferably from 0.1 to 10% by mass, and more preferably from 1 to 5% by mass.

[Fiber-Treating Silicone Compounds]

Fiber-treating silicone compounds are used for the purpose of improving the texture of laundered textile products.

The types of silicone compounds typically used for fiber treatments can be used as these fiber-treating silicone compounds, and specific examples include dimethyl silicones, polyether-modified silicones, methyl phenyl silicones, alkyl-modified silicones, higher fatty acid-modified silicones, methyl hydrogen silicones, fluorine-modified silicones, epoxy-modified silicones, carboxy-modified silicones, carbinol-modified silicones and amino-modified silicones. These silicones may be used individually, or appropriate combinations containing two or more silicones may be used.

The amount of the fiber-treating silicone compound in the detergent composition (1), relative to the total mass of the detergent composition (1), is preferably from 0.1 to 5% by mass, and more preferably from 0.5 to 3% by mass.

[Ultraviolet Absorbers]

Ultraviolet absorbers are used for the purpose of protecting the laundered textile products from ultraviolet rays.

Examples of the ultraviolet absorbers include derivative compounds of stilbene, benzophenone and benzotriazole, and stilbene derivatives are preferred. Among stilbene derivatives, the commercial products Tinosorb FD and Tinosorb FR manufactured by Ciba-Geigy Japan Ltd. are preferred, and Tinosorb FD is particularly desirable.

The amount of the ultraviolet absorber in the detergent composition (1), relative to the total mass of the detergent composition (1), is preferably from 0.01 to 1% by mass, and more preferably from 0.04 to 0.4% by mass.

[pH Modifiers]

There are no particular limitations on the pH of the detergent composition, but when the detergent composition is a solid detergent, from the viewpoint of the detergency performance, the pH of a 1% by mass aqueous solution of the detergent composition is preferably 8 or higher, and the pH of the 1% by mass aqueous solution is more preferably from 9 to 11. By ensuring that the pH is 8 or higher, the detergency effects can be enhanced.

In order to control the pH of the detergent composition, an alkaline agent is usually used to adjust the pH. Examples of this alkaline agent, in addition to the alkaline formulations mentioned above for the detergency builders, include alkanolamines such as monoethanolamine, diethanolamine and triethanolamine, as well as sodium hydroxide and potassium hydroxide.

For example, in terms of achieving the desired solubility in water and the desired degree of alkalinity, complex particles such as NABION 15 (a product name, manufactured by Rhodia Group), which is a mixture of sodium carbonate, sodium silicate and water in a ratio of 55/29/16 (mass ratio), may also be used.

Further, in order to ensure that the pH of the aforementioned 1% by mass aqueous solution does not become too high, an acid or the like may be used to adjust the pH to a value within the above range.

Examples of acids that may be used include the aforementioned metal ion scavengers, alkali metal dihydrogen phosphates such as potassium dihydrogen phosphate, as well as lactic acid, succinic acid, malic acid, gluconic acid and polycarboxylic acids thereof, as well as sodium hydrogen carbonate, sulfuric acid and hydrochloric acid.

These pH modifiers may be used individually, or appropriate combinations containing two or more pH modifiers may be used.

Furthermore, buffers may also be used for preventing any reduction in the pH due to acid components derived from fiber soiling during laundering.

The amount of the pH modifier in the detergent composition (1), relative to the total mass of the detergent composition (1), is preferably from 5 to 40% by mass, and more preferably from 10 to 30% by mass.

[Antioxidants]

Antioxidants are used for the purpose of improving the stability of the product.

There are no particular limitations on the antioxidant, and examples include the generally known types of natural antioxidants and synthetic antioxidants. Specific examples include mixtures of ascorbic acid, ascorbic acid palmitate and propyl gallate; BHT (butylated hydroxytoluene), BHA (butylated hydroxyanisole), mixtures of propyl gallate and citric acid, hydroquinone, tertiary-butylhydroquinone, natural tocopherol-based compounds, long-chain esters (C8 to C22) of gallic acid such as dodecyl gallate, Irganox-based compounds available from Ciba Specialty Chemicals Inc., citric acid and/or isopropyl citrate, 1-hydroxyethylidene-1, 1-diphosphonic acid (etidronic acid), 4,5-dihydroxy-m-benzenesulfonic acid or the sodium salt thereof, dimethoxyphenol, catechol, methoxyphenol, carotenoids, furans, and amino acids.

These antioxidants may be used individually, or appropriate combinations containing two or more antioxidants may be used.

The amount of the antioxidant in the detergent composition (1), relative to the total mass of the detergent composition (1), is preferably from 0.01 to 5% by mass, and more preferably from 0.1 to 1% by mass.

[Preservatives]

Preservatives are used for the purpose of preventing bacterial occurrence in liquid detergents.

Examples of the preservative include isothiazolone-based organosulfur compounds, benzisothiazolone-based organosulfur compounds, benzoic acids and 2-bromo-2-nitro-1,3-propanediol.

Specific examples of the isothiazolone-based organosulfur compounds include 5-chloro-2-methyl-4-isothiazolin-3-one, 2-n-butyl-3-isothiazolone, 2-benzyl-3-isothiazolone, 2-phenyl-3-isothiazolone, 2-methyl-4,5-dichloroisothiazolone, 5-chloro-2-methyl-3-isothiazolone, 2-methyl-4-isothiazolin-3-one, and mixtures of the above compounds. Among the above compounds, 5-chloro-2-methyl-4-isothiazolin-3-one and 2-methyl-4-isothiazolin-3-one are preferred, a mixture of 5-chloro-2-methyl-4-isothiazolin-3-one and 2-methyl-4-isothiazolin-3-one is more preferred, and a mixture containing about 77% by mass of the former and about 23% by mass of the latter is particularly desirable.

Specific examples of the benzisothiazolone-based organosulfur compounds include 1,2-benzisothiazolin-3-one, 2-methyl-4,5-trimethylene-4-isothiazolin-3-one, dithio-2,2-bis(benzmethylamide) as an analogous compound, and mixtures of the above compounds. Among these compounds, 1,2-benzisothiazolin-3-one is particularly desirable.

Examples of the benzoic acids include benzoic acids and salts thereof, para-hydroxybenzoic acid and salts thereof, methyl para-oxybenzoate, ethyl para-oxybenzoate, propyl para-oxybenzoate, butyl para-oxybenzoate and benzyl para-oxybenzoate.

Among the above compounds, benzisothiazolone-based compounds are preferred. These preservatives may be used individually, or appropriate combinations containing two or more preservatives may be used.

The amount of the preservative in the detergent composition (1), relative to the total mass of the detergent composition (1), is preferably from 10 to 1,000 ppm, and more preferably from 20 to 200 ppm.

[Process Agents]

When the detergent composition (1) is a solid (powder), sodium sulfate or calcium carbonate may sometimes be used as process agents.

When the detergent composition (1) is a solid, the amount of the process agent in the detergent composition (1), relative to the total mass of the detergent composition (1), is preferably from 1 to 40% by mass.

[Water]

Tap water, ion-exchanged water, pure water, or distilled water may all be used as the water, and among these possibilities, ion-exchanged water is ideal.

When the detergent composition (1) is a liquid, the amount of water within the detergent composition (1), relative to the total mass of the detergent composition (1), is preferably from 30 to 80% by mass, and more preferably from 40 to 70% by mass.

When the detergent composition (1) is a solid, the amount of water within the detergent composition (1), relative to the total mass of the detergent composition (1), is preferably from 1 to 10% by mass, more preferably from 2 to 10% by mass, and still more preferably from 3 to 7% by mass.

[Solvents]

There are no particular limitations on solvents other than water, and any of the solvents conventionally added to detergent compositions may be used.

The solvent is preferably a water-soluble solvent. The water-soluble solvent is preferably at least one solvent selected from the group consisting of lower alcohols (carbon number: 1 to 4), glycol ether-based solvents, and polyhydric alcohols, and is more preferably at least one solvent selected from the group consisting of ethanol, isopropanol, glycerol, ethylene glycol, propylene glycol, diethylene glycol, dipropylene glycol, hexylene glycol, polyoxyethylene phenyl ether, and compounds represented by general formula (II) shown below.

$$R^6—O—(C_2H_4O)_y—(C_3H_6)_z—H \quad (II)$$

In formula (II), $R^6$ represents an alkyl group or alkenyl group having a carbon number of 1 to 6 (and preferably a carbon number of 2 to 4). Further, y is a number representing the average number of repetitions of the oxyethylene group, and is preferably a number from 1 to 10, and more preferably a number from 2 to 5. Moreover, z is a number representing the average number of repetitions of the oxypropylene group, and is preferably a number from 0 to 5, and more preferably a number from 0 to 2.

Examples of the water-soluble solvents represented by formula (II) include butyl carbitol and diethylene glycol monopropylene glycol monobutyl ether.

Among the water-soluble solvents mentioned above, ethanol, ethylene glycol, butyl carbitol, propylene glycol, diethylene glycol monopropylene glycol monobutyl ether and glycerol are preferred.

When the detergent composition (1) is a liquid, the amount of the solvent within the detergent composition (1), relative to the total mass of the detergent composition (1), is preferably from 1 to 10% by mass, and more preferably from 2 to 5% by mass.

This amount does not include any solvent within the fragrance composition.

<Formulation and Physical Properties of the Detergent Composition (1)>

The detergent composition (1) may be in either solid or liquid form.

The term "solid detergent" is a generic term that includes detergents prepared in a variety of forms such as granular detergents (powdered or granular), tablet detergents, briquette detergents, bar-shaped detergents, and wrapped detergents in which a granular detergent or a paste-like detergent is wrapped in single doses in a water-soluble film or sheet or the like.

In terms of the usability of the present invention, the detergent composition (1) is preferably in solid form, and a granular composition is particularly preferred.

In the detergent composition (1), the amount of alkyl methyl ketones, measured using the measurement method described below, is preferably not more than 5.3 ng, and more preferably 4.0 ng or less. The smaller this amount of alkyl methyl ketones, the better the suppression of any deterioration in the aroma of the product, or inhibition of the development of the aroma from the fragrance (B), caused by the odors derived from the α-sulfo fatty acid alkyl ester salt, resulting in an improved aroma for the product.

(Method for Measuring Amount of Alkyl Methyl Ketones)

Three grams of the detergent composition is weighed accurately and placed in a sealable container (such as a vial) with a capacity of 20 mL, the container is sealed, and following standing for 30 minutes in a 40° C. thermostatic chamber, a solid-phase microextraction (hereafter abbreviated as SPME) fiber is exposed for one hour at 40° C. within the head space portion inside the container, thereby extracting the alkyl methyl ketones having an alkyl group with a carbon number of 4 to 8 from the head space portion. Following this extraction, the SPME fiber is analyzed using a gas chromatography-mass spectrometry apparatus (GC-MS), the total amount (ng) of the aforementioned alkyl methyl ketones extracted from the head space portion is determined, and that value is deemed the amount of alkyl methyl ketones.

In this description, the "head space" means the space formed, when the detergent composition is placed in a sealable container and sealed, between the surface of the composition and the lid of the container.

A solid-phase microextraction fiber describes needles obtained by chemically bonding or coating any of various liquid phases to the surface of fused silica rods.

An example of the measurement conditions used when performing the analysis using the gas chromatography-mass spectrometry apparatus is a method that involves inserting the solid-phase microextraction fiber directly into the injection port, introducing the extracted substances into the gas chromatograph column, and then detecting the ion intensities of the components that have been separated inside the column.

More detailed analysis conditions are described below in the "Examples" section.

As the amount of alkyl methyl ketones increases, the odors derived from the α-sulfo fatty acid alkyl ester salt are felt more strongly. Accordingly, the above method for measuring the amount of alkyl methyl ketones is useful as a method for measuring the odor of the detergent composition containing the α-sulfo fatty acid alkyl ester salt.

<Method for Producing Detergent Composition (1)>

There are no particular limitations on the method used for producing the detergent composition (1), and production can be achieved by normal methods in accordance with the formulation of the detergent composition that is to be produced.

One example of the production method in the case where the detergent composition is a liquid is a batch production method using a mixing kettle. This type of method includes a step of mixing the α-sulfo fatty acid alkyl ester salt, the fragrance composition, and any optional components that are used as required, with a liquid medium such as water.

Further, one example of the production method in the case where the detergent composition is a solid (powder) is a method including a step of adding the α-sulfo fatty acid alkyl ester salt, the fragrance composition, and any optional components that are used as required to a liquid medium such as water and performing mixing.

Alternatively, other examples of the production method in the case where the detergent composition is a solid include a method in which particles containing the α-sulfo fatty acid alkyl ester salt and any optional components that are used as required (hereafter referred to as the base particles or the base detergent) are sprayed with the fragrance composition, and a method in which the particles obtained in the above method are molded into a desired form.

The particles that constitute the base particles may be of a single type or two or more different types. The base particles must include at least particles containing the α-sulfo fatty acid alkyl ester salt. In those cases where the detergent composition (1) also includes one or more optional components, those optional components may be incorporated within the particles containing the α-sulfo fatty acid alkyl ester salt, or may be included in other particles that do not contain the α-sulfo fatty acid alkyl ester salt.

The particles containing the α-sulfo fatty acid alkyl ester salt may be either commercially available particles, or particles produced using a conventional production method (such as one of the methods described above as an example of the method for producing the α-sulfo fatty acid alkyl ester salt).

In those cases where the base particles also include an optional component such as another surfactant or a detergency builder or the like, any of the methods (1) to (3) described below are preferred as the method for producing the base particles.

(1) A method in which a slurry containing the raw materials for the base particles (hereafter referred to as the detergent raw materials) is prepared, and the slurry is then spray dried to form spray dried particles.

(2) A method in which spray dried particles containing a portion of the detergent raw materials are combined with the remaining detergent raw materials, and the resulting mixture is then granulated using a kneading-extrusion granulation method (kneading, extrusion, grinding), an agitation granulation method, or a rolling granulation method or the like, thus forming granules.

(3) A method in which particles containing mutually different detergent raw materials (such as powdered raw materials, spray dried particles or granules) are mixed together mechanically (powder mixing).

When producing the base particles, in the method (1) described above, the α-sulfo fatty acid alkyl ester salt may be added to the slurry used for performing spray drying. In the method (2) described above, the α-sulfo fatty acid alkyl ester salt may be mixed with the spray dried particles during granulation. Further, in the method (3) described above, the α-sulfo fatty acid alkyl ester salt in powder form may be subjected to powder mixing with other particles that do not contain the α-sulfo fatty acid alkyl ester salt.

When the method (3) is used to perform powder mixing of the particles of the α-sulfo fatty acid alkyl ester salt with other particles, the effects of the odors derived from the α-sulfo fatty acid alkyl ester salt tend to appear most strongly in the obtained detergent composition (1). Accordingly, because the usefulness of the present invention is greatest in this method, the method for producing the base particles is preferably a method such as that described above in (3), in which the α-sulfo fatty acid alkyl ester salt in powder form is subjected to powder mixing with other particles that do not contain the α-sulfo fatty acid alkyl ester salt.

One example of a preferred method for producing the base particles is a method that includes performing powder mixing of spray dried particles, obtained by preparing a slurry by uniformly mixing some or all of the detergent raw materials besides the α-sulfo fatty acid alkyl ester salt with water and then spray drying this slurry, the powdered α-sulfo fatty acid alkyl ester salt, and any remaining detergent raw materials (in powdered form, in those cases where only some of the detergent raw materials besides the α-sulfo fatty acid alkyl ester salt are added to the slurry). Examples of the detergent raw materials besides the α-sulfo fatty acid alkyl ester salt include the optional components described above. In particular, the inclusion of surfactants, detergency builders, water, polymers and fluorescent brighteners is preferred, and form the viewpoint of stabilizing the slurry dispersion, the inclusion of one or more polymers is particularly desirable.

The slurry is preferably formed by mixing some or all of the detergent raw materials besides the α-sulfo fatty acid alkyl ester salt with water at 40 to 80° C. for a period of 20 minutes to 2 hours. In the spray drying, the obtained slurry is preferably dried at 200 to 400° C. so that the moisture content of the particles becomes 2 to 10% by mass. The average particle size of the obtained spray dried particles is preferably from 200 to 600 μm, and more preferably from 300 to 500 μm.

In the case of powder mixing, the mixing is performed using a mixer such as a trommel. The powder mixing is preferably performed at 10 to 50° C. The average particle size of the powdered α-sulfo fatty acid alkyl ester salt is preferably from 200 to 600 μm, and more preferably from 300 to 500 μm. The average particle size of the remaining detergent raw materials is preferably from 200 to 1,000 μm, and more preferably from 300 to 500 μm. The average particle size of the obtained base particles is preferably from 200 to 1,000 μm, and more preferably from 300 to 500 μm. The average particle size can be measured using sieves.

The amount (pure fraction) of the α-sulfo fatty acid alkyl ester salt within the powdered α-sulfo fatty acid alkyl ester salt used in the powder mixing, relative to the total mass of the powder, is preferably from 50 to 90% by mass, and more preferably from 60 to 90% by mass. Provided the amount is at least 60% by mass, aggregation and clumping of the powder during storage can be suppressed, and provided the amount is not more than 90% by mass, the solubility in water is excellent.

The powdered α-sulfo fatty acid alkyl ester salt may include impurities formed during the production process, or assistants (such as zeolites) used during granulation or grinding.

The method used for spraying the fragrance composition onto the base particles is preferably a method in which a sprayer is used to spray 1 to 10 g of the fragrance composition onto 500 to 1,000 g of the base particles at a temperature of 10 to 30° C.

<<Detergent Composition of Second Aspect>>

A detergent composition of the second aspect of the present invention (hereafter also referred to as the detergent composition (2)) contains an α-sulfo fatty acid alkyl ester salt and a fragrance composition.

<α-Sulfo Fatty Acid Alkyl Ester Salt>

The α-sulfo fatty acid alkyl ester salt is the same as described above.

The detergent composition (2) may contain a single α-sulfo fatty acid alkyl ester salt or two or more α-sulfo fatty acid alkyl ester salts.

The amount of the α-sulfo fatty acid alkyl ester salt within the detergent composition (2), relative to the total mass of the detergent composition (2), is typically from 1 to 30% by mass, preferably from 4 to 30% by mass, more preferably from 8 to 30% by mass, and still more preferably from 8 to 20% by mass.

Provided that the amount of the α-sulfo fatty acid alkyl ester salt is at least 1% by mass, the effect of the α-sulfo fatty acid alkyl ester salt in improving the detergency performance can be enhanced, and provided the amount is not more than 30% by mass, the effects of the invention (for example, the suppression effect on the unpleasantness resulting from odors derived from the α-sulfo fatty acid alkyl ester salt, and the suppression effect on any inhibition by the aforementioned odors on the development of the fragrance aroma) are more effective.

<Fragrance Composition>

The fragrance composition contains the fragrance (A). The fragrance (A) is the same as described above.

The fragrance composition may also contain other fragrance components besides the fragrance (A) and solvents and the like as required. Examples of these fragrance components besides the fragrance (A) and solvents are the same as those mentioned above.

In particular, the fragrance composition preferably contains the fragrance (B) as a fragrance component besides the fragrance (A). The fragrance (B) is the same as described above.

The amount of the fragrance (A) within the fragrance composition, relative to the total mass of the fragrance composition, is typically at least 20% by mass, preferably at least 30% by mass, and more preferably 50% by mass or greater. More specifically, the amount is preferably from 70 to 90% by mass, and more preferably from 80 to 90% by mass.

Further, the amount of the fragrance composition in the detergent composition (2), relative to the total mass of the detergent composition (2), is typically from 0.25 to 1% by mass, preferably from 0.25 to 0.7% by mass, and more preferably from 0.25 to 0.5% by mass.

Provided that the amount of the fragrance composition in the detergent composition (2) is at least 0.25% by mass, and the amount of the fragrance (A) within the fragrance composition is at least 20% by mass, any deterioration in the product aroma due to odors derived from the α-sulfo fatty acid alkyl ester salt is suppressed. Further, when the fragrance composition also contains the fragrance (B), inhibition of the development of the aroma from the fragrance (B) due to the aforementioned odors is also suppressed. As a result, the aroma of the product is favorable.

There are no particular limitations on the upper limit for the amount of the fragrance (A) within the fragrance composition, which may be set appropriately in accordance with the amounts of any other fragrance components or solvents or the like that may be added according to need.

When the fragrance composition also contains the fragrance (B), the amount of the fragrance (B) within the fragrance composition is an amount that results in a mass ratio of the fragrance (A) relative to the fragrance (B), represented by A/B, that is at least 1 but not more than 10.

In other words, the amount of the fragrance (B) relative to 100 parts by mass of the fragrance (A) is at least 10 parts by mass but not more than 100 parts by mass. A/B is preferably at least 1 but not more than 9, and more preferably at least 1 but not more than 7.

The value of A/B in the fragrance composition is the same as the value of A/B in the detergent composition (2).

<Optional Components>

The detergent composition (2) may, if required, include other components besides the α-sulfo fatty acid alkyl ester salt and the fragrance composition. Examples of these other components include surfactants other than α-sulfo fatty acid alkyl ester salts, detergency builders, colorants, fluorescent brighteners, bleaching agents, bleach activators, bleach activation catalysts, enzymes, enzyme stabilizers, polymers, caking inhibitors, anti-foaming agents, reducing agents, metal ion scavengers, clay minerals, fiber-treating silicone compounds, ultraviolet absorbers, pH modifiers, antioxidants and preservatives. Further, if necessary the detergent composition may also include liquid media such as water or solvents. Specific examples of these optional components include the same components as those mentioned above in relation to the detergent composition (1). The amounts of these components may also satisfy the same ranges as those described above in relation to the detergent composition (1).

<Formulation and Physical Properties of the Detergent Composition (2)>

The detergent composition (2) may be in either solid or liquid form.

The term "solid detergent" is a generic term that includes detergents prepared in a variety of forms such as granular detergents (powdered or granular), tablet detergents, briquette detergents, bar-shaped detergents, and wrapped detergents in which a granular detergent or a paste-like detergent is wrapped in single doses in a water-soluble film or sheet or the like.

In terms of the usability of the present invention, the detergent composition (2) is preferably in solid form, and a granular composition is particularly preferred.

In the detergent composition (2), the amount of alkyl methyl ketones, measured using the measurement method described below, is preferably not more than 5.3 ng, and more preferably 4.0 ng or less. The smaller this amount of alkyl methyl ketones, the better the suppression of any deterioration in the aroma of the product, or inhibition of the development of the aroma from the fragrance (B), caused by the odors derived from the α-sulfo fatty acid alkyl ester salt, resulting in an improved aroma for the product.

(Method for Measuring Amount of Alkyl Methyl Ketones)

Three grams of the detergent composition is weighed accurately and placed in a sealable container (such as a vial) with a capacity of 20 mL, the container is sealed, and following standing for 30 minutes in a 40° C. thermostatic chamber, an SPME fiber is exposed for one hour at 40° C. within the head space portion inside the container, thereby extracting the alkyl methyl ketones having an alkyl group with a carbon number of 4 to 8 from the head space portion. Following this extraction, the SPME fiber is analyzed using a GC-MS apparatus, the total amount (ng) of the aforementioned alkyl methyl ketones extracted from the head space portion is determined, and that value is deemed the amount of alkyl methyl ketones.

More detailed analysis conditions are described below in the "Examples" section.

<Method for Producing Detergent Composition (2)>

There are no particular limitations on the method used for producing the detergent composition (2), and in a similar manner to the detergent composition (1), production can be performed by normal methods in accordance with the formulation of the detergent composition that is to be produced.

For example, when the detergent composition is granular, the targeted detergent composition can be produced in the manner described above, by spraying the fragrance composition onto particles (base particles) containing the components other than the fragrance.

<<Actions and Effects>>

In the present invention, by including at least a specific amount of the fragrance (A) in the detergent composition, the effects of odors derived from the α-sulfo fatty acid alkyl ester salt on the aroma of the product can be suppressed.

For example, the effect where the odors derived from the α-sulfo fatty acid alkyl ester salt cause a deterioration in the product aroma that causes the user some unpleasantness can be suppressed. Further, when the fragrance (B) is also included in order to provide the product with a distinctive aroma, any inhibition of the development of the aroma from the fragrance (B) by the aforementioned odors is also suppressed, meaning the aroma of the fragrance (B) can fully develop, resulting in an improved product aroma.

For example, in the case where the detergent composition (1) or (2) is a detergent product that is stored inside a sealed container, when the user opens the container in order to use the detergent composition (1) or (2), thus releasing the air in the head space portion, the user feels no unpleasantness, and can fully appreciate the product aroma provided by the fragrance (B).

The fragrance (A) has a comparatively weak aroma as a fragrance component, and it is thought that the effects described above are the result of an action other than mere masking.

Based on investigations performed by the inventors of the present invention, it appears that when a detergent composition containing an α-sulfo fatty acid alkyl ester salt is stored in a container, lactones are released as odorous components and accumulate in the head space. In addition to these lactones, methyl ketones, aldehydes, and fatty acids and the like also accumulate in the head space portion. Each of these components is a mixture of compounds having an alkyl chain length distribution. For example, in the case of the methyl ketones, the component is a mixture of methyl alkyl ketones having an alkyl chain length with a carbon number of about 4 to 12. It is thought that the amount of these alkyl methyl ketones is a useful indicator for evaluating the effect of the invention in suppressing the odors derived from the α-sulfo fatty acid alkyl ester salt.

As illustrated in the examples described below, if at least a certain amount of the fragrance (A) is added to a detergent composition, then the amount of alkyl methyl ketones having an alkyl group carbon number of 4 to 8 within the head space can be reduced. Based on this observation, it is thought that the fragrance (A) is able to reduce the amount of odorous components derived from the α-sulfo fatty acid alkyl ester salt within the head space, thus providing the effects described above.

The odorous components derived from the α-sulfo fatty acid alkyl ester salt vary depending on the raw materials for the α-sulfo fatty acid alkyl ester salt and the conditions used in the production process (such as the reaction rate and the bleaching rate), and the amount of odorous components varies even among commercially available MES products. As a result, conventionally, a problem has arisen in that even if the composition of a detergent composition is the same, the product aroma can vary depending on the α-sulfo fatty acid alkyl ester salt being used.

In contrast, in the present invention, because the effects of these odorous components derived from the α-sulfo fatty acid alkyl ester salt on the aroma of the product can be suppressed, even if the amount of odorous components derived from the α-sulfo fatty acid alkyl ester salt fluctuates, the aroma of the fragrance (B) can still develop in a stable manner. As a result, in the present invention, even when a detergent composition is produced industrially on a large scale, the composition is unaffected by any fluctuations in the amount of odorous components derived from the α-sulfo fatty acid alkyl ester salt, meaning a detergent composition with a stable fragrance can be obtained.

One aspect of the detergent composition of the present invention contains an α-sulfo fatty acid alkyl ester salt and a fragrance composition, wherein the amount of the α-sulfo fatty acid alkyl ester salt is from 1 to 30% by mass relative to the total mass of the detergent composition, the fragrance composition contains a fragrance (A) containing at least one fragrance component selected from the group consisting of dihydromyrcenol, isobornyl acetate, tricyclodecenyl acetate and tricyclodecenyl propionate, and the amount of the fragrance (A) is from 0.07 to 0.5% by mass relative to the total mass of the detergent composition.

Another aspect of the detergent composition of the present invention contains an α-sulfo fatty acid alkyl ester salt and a fragrance composition, wherein the amount of the α-sulfo fatty acid alkyl ester salt is from 1 to 30% by mass relative to the total mass of the detergent composition, the fragrance composition contains a fragrance (A) containing at least one fragrance component selected from the group consisting of α-hexyl cinnamic aldehyde, amyl salicylate, Iso E Super and habanolide, and the amount of the fragrance (A) is from 0.07 to 0.5% by mass relative to the total mass of the detergent composition.

Yet another aspect of the detergent composition of the present invention contains an α-sulfo fatty acid alkyl ester salt and a fragrance composition, wherein the amount of the α-sulfo fatty acid alkyl ester salt is from 1 to 30% by mass relative to the total mass of the detergent composition, the fragrance composition contains a fragrance (A) containing at least one fragrance component selected from the group consisting of lilial, tetrahydrolinalool, verdox and vertenex, and the amount of the fragrance (A) is from 0.07 to 0.5% by mass relative to the total mass of the detergent composition.

Yet another aspect of the detergent composition of the present invention contains an α-sulfo fatty acid alkyl ester salt and a fragrance composition, wherein the amount of the α-sulfo fatty acid alkyl ester salt is from 1 to 30% by mass relative to the total mass of the detergent composition, the fragrance composition contains a fragrance (A) composed of at least one fragrance component selected from the group consisting of dihydromyrcenol, isobornyl acetate, tricyclodecenyl acetate and tricyclodecenyl propionate, and at least one fragrance component selected from the group consisting of α-hexyl cinnamic aldehyde, amyl salicylate, Iso E Super and habanolide, and the amount of the fragrance (A) is from 0.07 to 0.5% by mass relative to the total mass of the detergent composition.

Yet another aspect of the detergent composition of the present invention contains an α-sulfo fatty acid alkyl ester salt and a fragrance composition, wherein the amount of the α-sulfo fatty acid alkyl ester salt is from 1 to 30% by mass relative to the total mass of the detergent composition, the fragrance composition contains a fragrance (A) composed of at least one fragrance component selected from the group consisting of dihydromyrcenol, isobornyl acetate, tricyclodecenyl acetate and tricyclodecenyl propionate, and at least one fragrance component selected from the group consisting of α-hexyl cinnamic aldehyde, amyl salicylate, Iso E Super and habanolide, the mass ratio between the at least one fragrance component selected from the group consisting of dihydromyrcenol, isobornyl acetate, tricyclodecenyl acetate and tricyclodecenyl propionate, and the at least one fragrance component selected from the group consisting of α-hexyl cinnamic aldehyde, amyl salicylate, Iso E Super and habanolide is 1:1, and the amount of the fragrance (A) is from 0.07 to 0.5% by mass relative to the total mass of the detergent composition.

Yet another aspect of the detergent composition of the present invention contains an α-sulfo fatty acid alkyl ester salt and a fragrance composition, wherein the amount of the α-sulfo fatty acid alkyl ester salt is from 1 to 30% by mass relative to the total mass of the detergent composition, the fragrance composition contains a fragrance (A) composed of at least one fragrance component selected from the group consisting of dihydromyrcenol, isobornyl acetate, tricyclodecenyl acetate and tricyclodecenyl propionate, and at least one fragrance component selected from the group consisting of lilial, tetrahydrolinalool, verdox and vertenex, and the amount of the fragrance (A) is from 0.07 to 0.5% by mass relative to the total mass of the detergent composition.

Yet another aspect of the detergent composition of the present invention contains an α-sulfo fatty acid alkyl ester salt and a fragrance composition, wherein the amount of the α-sulfo fatty acid alkyl ester salt is from 1 to 30% by mass relative to the total mass of the detergent composition, the fragrance composition contains a fragrance (A) composed of at least one fragrance component selected from the group consisting of dihydromyrcenol, isobornyl acetate, tricyclodecenyl acetate and tricyclodecenyl propionate, and at least one fragrance component selected from the group consisting of lilial, tetrahydrolinalool, verdox and vertenex, the mass ratio between the at least one fragrance component selected from the group consisting of dihydromyrcenol, isobornyl acetate, tricyclodecenyl acetate and tricyclodecenyl propionate, and the at least one fragrance component selected from the group consisting of lilial, tetrahydrolinalool, verdox and vertenex is 1:1, and the amount of the fragrance (A) is from 0.07 to 0.5% by mass relative to the total mass of the detergent composition.

Yet another aspect of the detergent composition of the present invention contains an α-sulfo fatty acid alkyl ester salt and a fragrance composition, wherein the amount of the α-sulfo fatty acid alkyl ester salt is from 1 to 30% by mass relative to the total mass of the detergent composition, the fragrance composition contains a fragrance (A) composed of at least one fragrance component selected from the group consisting of α-hexyl cinnamic aldehyde, amyl salicylate, Iso E Super and habanolide, and at least one fragrance component selected from the group consisting of lilial, tetrahydrolinalool, verdox and vertenex, and the amount of the fragrance (A) is from 0.07 to 0.5% by mass relative to the total mass of the detergent composition.

Yet another aspect of the detergent composition of the present invention contains an α-sulfo fatty acid alkyl ester salt and a fragrance composition, wherein the amount of the α-sulfo fatty acid alkyl ester salt is from 1 to 30% by mass relative to the total mass of the detergent composition, the fragrance composition contains a fragrance (A) composed of at least one fragrance component selected from the group consisting of α-hexyl cinnamic aldehyde, amyl salicylate, Iso E Super and habanolide, and at least one fragrance component selected from the group consisting of lilial, tetrahydrolinalool, verdox and vertenex, the mass ratio between the at least one fragrance component selected from the group consisting of α-hexyl cinnamic aldehyde, amyl salicylate, Iso E Super and habanolide, and the at least one fragrance component selected from the group consisting of lilial, tetrahydrolinalool, verdox and vertenex is 1:1, and the amount of the fragrance (A) is from 0.07 to 0.5% by mass relative to the total mass of the detergent composition.

Yet another aspect of the detergent composition of the present invention contains an α-sulfo fatty acid alkyl ester salt and a fragrance composition, wherein the amount of the α-sulfo fatty acid alkyl ester salt is from 1 to 30% by mass relative to the total mass of the detergent composition, the fragrance composition contains a fragrance (A) composed of at least one fragrance component selected from the group consisting of dihydromyrcenol, isobornyl acetate, tricyclodecenyl acetate and tricyclodecenyl propionate, at least one fragrance component selected from the group consisting of α-hexyl cinnamic aldehyde, amyl salicylate, Iso E Super and habanolide, and at least one fragrance component selected from the group consisting of lilial, tetrahydrolinalool, verdox and vertenex, the amount of the fragrance (A) is from 0.07 to 0.5% by mass relative to the total mass of the detergent composition.

Yet another aspect of the detergent composition of the present invention contains an α-sulfo fatty acid alkyl ester salt and a fragrance composition, wherein the amount of the α-sulfo fatty acid alkyl ester salt is from 1 to 30% by mass relative to the total mass of the detergent composition, the fragrance composition contains a fragrance (A) composed of at least one combination selected from the group consisting of a combination of dihydromyrcenol, isobornyl acetate, α-hexyl cinnamic aldehyde, lilial, tetrahydrolinalool, amyl salicylate, verdox, vertenex, tricyclodecenyl acetate, tricyclodecenyl propionate, Iso E Super and habanolide; a combination of dihydromyrcenol, verdox and habanolide; a combination of isobornyl acetate, tetrahydrolinalool and Iso E Super; a combination of amyl salicylate, vertenex and tricyclodecenyl propionate; a combination of α-hexyl cinnamic aldehyde, lilial and tricyclodecenyl acetate; a combination of α-hexyl cinnamic aldehyde, lilial and tricyclodecenyl propionate; a combination of lilial, amyl salicylate and tricyclodecenyl propionate; a combination of lilial, tricyclodecenyl propionate and Iso E Super; a combination of lilial, tricyclodecenyl propionate and habanolide; a combination of α-hexyl cinnamic aldehyde, tetrahydrolinalool and tricyclodecenyl propionate; a combination of tetrahydrolinalool, amyl salicylate and tricyclodecenyl propionate; a combination of tetrahydrolinalool, tricyclodecenyl propionate and Iso E Super; a combination of tetrahydrolinalool, tricyclodecenyl propionate and habanolide; a combination of α-hexyl cinnamic aldehyde, verdox and tricyclodecenyl propionate; a combination of amyl salicylate, verdox and tricyclodecenyl propionate; a combination of verdox, tricyclodecenyl propionate and Iso E Super; a combination of verdox, tricyclodecenyl propionate and habanolide; a combination of α-hexyl cinnamic aldehyde, verdox and tricyclodecenyl propionate; a combination of verdox, tricyclodecenyl propionate and Iso E Super, a combination of verdox, tricyclodecenyl propionate and habanolide; a combination of α-hexyl cinnamic aldehyde, vertenex and tricyclodecenyl propionate; a combination of vertenex, tricyclodecenyl propionate and Iso E Super; a combination of vertenex, tricyclodecenyl propionate and habanolide; a combination of lilial, amyl salicylate and tricyclodecenyl acetate; a combination of lilial, tricyclodecenyl acetate and Iso E Super; a combination of lilial, tricyclodecenyl acetate and habanolide; a combination of α-hexyl cinnamic aldehyde, tetrahydrolinalool and tricyclodecenyl acetate; a combination of tetrahydrolinalool, amyl salicylate and tricyclodecenyl acetate; a combination of tetrahydrolinalool, tricyclodecenyl acetate and Iso E Super; a combination of tetrahydrolinalool, tricyclodecenyl acetate and habanolide; a combination of α-hexyl cinnamic aldehyde, verdox and tricyclodecenyl acetate; a combination of amyl salicylate, verdox and tricyclodecenyl acetate; a combination of verdox, tricyclodecenyl acetate and Iso E Super; a combination of verdox, tricyclodecenyl acetate and habanolide; a combination of α-hexyl cinnamic aldehyde, vertenex and tricyclodecenyl acetate; a combination of amyl salicylate, vertenex and tricyclodecenyl acetate; a combination of vertenex, tricyclodecenyl acetate and Iso E Super; a combination of vertenex, tricyclodecenyl acetate and habanolide; a combination of isobornyl acetate, α-hexyl cinnamic aldehyde and lilial; a combination of isobornyl acetate, lilial and amyl salicylate; a combination of isobornyl acetate, lilial and Iso E Super; a combination of isobornyl acetate, lilial and habanolide; a combination of isobornyl acetate, α-hexyl cinnamic aldehyde and tetrahydrolinalool; a combination of isobornyl acetate, tetrahydrolinalool and amyl salicylate; a combination of isobornyl acetate, tetrahydrolinalool and habanolide; a combination of isobornyl acetate, α-hexyl cinnamic aldehyde and verdox; a combination of isobornyl acetate, amyl salicylate and verdox; a combination of isobornyl acetate, verdox and Iso E Super; a combination of isobornyl acetate, verdox and habanolide; a combination of isobornyl acetate, α-hexyl cinnamic aldehyde and vertenex; a combination of isobornyl acetate, amyl salicylate and vertenex; a combination of isobornyl acetate, vertenex and Iso E Super; a combination of isobornyl acetate, vertenex and habanolide; a combination of dihydromyrcenol, α-hexyl cinnamic aldehyde and lilial; a combination of dihydromyrcenol, lilial and amyl salicylate; a combination of dihydromyrcenol, lilial and Iso E Super; a combination of dihydromyrcenol, lilial and habanolide; a combination of dihydromyrcenol, α-hexyl cinnamic aldehyde and tetrahydrolinalool; a combination of dihydromyrcenol, tetrahydrolinalool and amyl salicylate; a combination of dihydromyrcenol, tetrahydrolinalool and Iso E Super; a combination of dihydromyrcenol, tetrahydrolinalool and habanolide; a combination of dihydromyrcenol, α-hexyl cinnamic aldehyde and habanolide; a combination of dihydromyrcenol, α-hexyl cinnamic aldehyde and verdox; a combination of dihydromyrcenol, amyl salicylate and verdox; a combination of dihydromyrcenol, verdox and Iso E Super; a combination of dihydromyrcenol, α-hexyl cinnamic aldehyde and vertenex; a combination of dihydromyrcenol, amyl salicylate and vertenex; a combination of dihydromyrcenol, vertenex and Iso E Super; or a combination of dihydromyrcenol, vertenex and habanolide, and the amount of the fragrance (A) is from 0.07 to 0.5% by mass relative to the total mass of the detergent composition.

Yet another aspect of the detergent composition of the present invention contains an α-sulfo fatty acid alkyl ester salt and a fragrance composition, wherein the amount of the α-sulfo fatty acid alkyl ester salt is from 1 to 30% by mass relative to the total mass of the detergent composition, the fragrance composition contains a fragrance (A) composed of at least one fragrance component selected from the group consisting of dihydromyrcenol, isobornyl acetate, tricyclodecenyl acetate and tricyclodecenyl propionate, at least one fragrance component selected from the group consisting of α-hexyl cinnamic aldehyde, amyl salicylate, Iso E Super and habanolide, and at least one fragrance component selected from the group consisting of lilial, tetrahydrolinalool, verdox and vertenex, the mass ratio between the at least one fragrance component selected from the group consisting of dihydromyrcenol, isobornyl acetate, tricyclodecenyl acetate and tricyclodecenyl propionate, the at least one fragrance component selected from the group consisting of α-hexyl cinnamic aldehyde, amyl salicylate, Iso E Super and habanolide, and the at least one fragrance component selected from the group consisting of lilial, tetrahydrolinalool, verdox and vertenex is 1:1:1, and the amount of the fragrance (A) is from 0.07 to 0.5% by mass relative to the total mass of the detergent composition.

Yet another aspect of the detergent composition of the present invention contains an α-sulfo fatty acid alkyl ester salt and a fragrance composition, wherein the amount of the α-sulfo fatty acid alkyl ester salt is from 1 to 30% by mass relative to the total mass of the detergent composition, the fragrance composition contains a fragrance (A) composed of at least one fragrance component selected from the group consisting of dihydromyrcenol, isobornyl acetate, tricyclodecenyl acetate and tricyclodecenyl propionate, at least one fragrance component selected from the group consisting of α-hexyl cinnamic aldehyde, amyl salicylate, Iso E Super and habanolide, and at least one fragrance component selected from the group consisting of lilial, tetrahydrolinalool, verdox and vertenex, and a fragrance (B) composed of at least one fragrance component selected from the group consisting of allyl cyclohexyl propionate, 1,8-cineole, camphor, diphenyl oxide, β-naphthol methyl ether, citronellyl nitrile, menthone, citronellal, triplal, dodecane nitrile, 3,7-dimethyl-2,6-nonadienenitrile, ethyl 2-methylbutyrate, ethyl 2-methylvalerate and patchouli oil, and the amount of the fragrance (A) is from 0.07 to 0.5% by mass relative to the total mass of the detergent composition.

Yet another aspect of the detergent composition of the present invention contains an α-sulfo fatty acid alkyl ester salt and a fragrance composition, wherein the amount of the α-sulfo fatty acid alkyl ester salt is from 1 to 30%/o by mass relative to the total mass of the detergent composition, the fragrance composition contains a fragrance (A) composed of at least one fragrance component selected from the group consisting of dihydromyrcenol, isobornyl acetate, tricyclodecenyl acetate and tricyclodecenyl propionate, at least one fragrance component selected from the group consisting of α-hexyl cinnamic aldehyde, amyl salicylate, Iso E Super and habanolide, and at least one fragrance component selected from the group consisting of lilial, tetrahydrolinalool, verdox and vertenex, and a fragrance (B) composed of at least one fragrance component selected from the group consisting of allyl cyclohexyl propionate, 1,8-cineole, camphor, diphenyl oxide, β-naphthol methyl ether, citronellyl nitrile, menthone, citronellal, triplal, dodecane nitrile, 3,7-dimethyl-2,6-nonadienenitrile, ethyl 2-methylbutyrate, ethyl 2-methylvalerate and patchouli oil, the mass ratio between the at least one fragrance component selected from the group consisting of dihydromyrcenol, isobornyl acetate, tricyclodecenyl acetate and tricyclodecenyl propionate, the at least one fragrance component selected from the group consisting of α-hexyl cinnamic aldehyde, amyl salicylate, Iso E Super and habanolide, and the at least one fragrance component selected from the group consisting of lilial, tetrahydrolinalool, verdox and vertenex is 1:1:1, and the amount of the fragrance (A) is from 0.07 to 0.5% by mass relative to the total mass of the detergent composition.

Yet another aspect of the detergent composition of the present invention contains an α-sulfo fatty acid alkyl ester salt and a fragrance composition, wherein the amount of the α-sulfo fatty acid alkyl ester salt is from 1 to 30% by mass relative to the total mass of the detergent composition, the fragrance composition contains a fragrance (A) composed of at least one fragrance component selected from the group consisting of dihydromyrcenol, isobornyl acetate, tricyclodecenyl acetate and tricyclodecenyl propionate, at least one fragrance component selected from the group consisting of α-hexyl cinnamic aldehyde, amyl salicylate, Iso E Super and habanolide, and at least one fragrance component selected from the group consisting of lilial, tetrahydrolinalool, verdox and vertenex, and a fragrance (B) composed of at least one fragrance component selected from the group consisting of allyl cyclohexyl propionate, 1,8-cineole, camphor, diphenyl oxide, β-naphthol methyl ether, citronellyl nitrile, menthone, citronellal, triplal, dodecane nitrile, 3,7-dimethyl-2,6-nonadienenitrile, ethyl 2-methylbutyrate, ethyl 2-methylvalerate and patchouli oil, the mass ratio of the fragrance (A) relative to the fragrance (B), represented by (mass of fragrance (A))/(mass of fragrance (B)), is at least 1 but not more than 10, and the amount of the fragrance (A) is from 0.07 to 0.5% by mass relative to the total mass of the detergent composition.

Yet another aspect of the detergent composition of the present invention contains an α-sulfo fatty acid alkyl ester salt and a fragrance composition, wherein the amount of the α-sulfo fatty acid alkyl ester salt is from 1 to 30% by mass relative to the total mass of the detergent composition, the fragrance composition contains a fragrance (A) composed of at least one fragrance component selected from the group consisting of dihydromyrcenol, isobornyl acetate, tricyclodecenyl acetate and tricyclodecenyl propionate, at least one fragrance component selected from the group consisting of α-hexyl cinnamic aldehyde, amyl salicylate, Iso E Super and habanolide, and at least one fragrance component selected from the group consisting of lilial, tetrahydrolinalool, verdox and vertenex, and a fragrance (B) composed of at least one fragrance component selected from the group consisting of allyl cyclohexyl propionate, 1,8-cineole, camphor, diphenyl oxide, β-naphthol methyl ether, citronellyl nitrile, menthone, citronellal, triplal, dodecane nitrile, 3,7-dimethyl-2,6-nonadienenitrile, ethyl 2-methylbutyrate, ethyl 2-methylvalerate and patchouli oil, the mass ratio between the at least one fragrance component selected from the group consisting of dihydromyrcenol, isobornyl acetate, tricyclodecenyl acetate and tricyclodecenyl propionate, the at least one fragrance component selected from the group consisting of α-hexyl cinnamic aldehyde, amyl salicylate, Iso E Super and habanolide, and the at least one fragrance component selected from the group consisting of lilial, tetrahydrolinalool, verdox and vertenex is 1:1:1, the mass ratio of the fragrance (A) relative to the fragrance (B), represented by (mass of fragrance (A))/(mass of fragrance (B)), is at least 1 but not more than 10, and the amount of the fragrance (A) is from 0.07 to 0.5% by mass relative to the total mass of the detergent composition.

Yet another aspect of the detergent composition of the present invention contains an α-sulfo fatty acid alkyl ester salt and a fragrance composition, wherein the amount of the α-sulfo fatty acid alkyl ester salt is from 1 to 30% by mass relative to the total mass of the detergent composition, the fragrance composition contains a fragrance (A) composed of at least one combination selected from the group consisting of a combination of dihydromyrcenol, isobornyl acetate, α-hexyl cinnamic aldehyde, lilial, tetrahydrolinalool, amyl salicylate, verdox, vertenex, tricyclodecenyl acetate, tricyclodecenyl propionate, Iso E Super and habanolide; a combination of dihydromyrcenol, verdox and habanolide; a combination of isobornyl acetate, tetrahydrolinalool and Iso E Super; a combination of amyl salicylate, vertenex and tricyclodecenyl propionate; a combination of α-hexyl cinnamic aldehyde, lilial and tricyclodecenyl acetate; a combination of α-hexyl cinnamic aldehyde, lilial and tricyclodecenyl propionate; a combination of lilial, amyl salicylate and tricyclodecenyl propionate; a combination of lilial, tricyclodecenyl propionate and Iso E Super; a combination of lilial, tricyclodecenyl propionate and habanolide; a combination of α-hexyl cinnamic aldehyde, tetrahydrolinalool and tricyclodecenyl propionate; a combination of tetrahydrolinalool, amyl salicylate and tricyclodecenyl propionate; a combination of tetrahydrolinalool, tricyclodecenyl propionate and Iso E Super; a combination of tetrahydrolinalool, tricyclodecenyl propionate and habanolide; a combination of α-hexyl cinnamic aldehyde, verdox and tricyclodecenyl propionate; a combination of amyl salicylate, verdox and tricyclodecenyl propionate; a combination of verdox, tricyclodecenyl propionate and Iso E Super; a combination of verdox, tricyclodecenyl propionate and habanolide; a combination of α-hexyl cinnamic aldehyde, verdox and tricyclodecenyl propionate; a combination of verdox, tricyclodecenyl propionate and Iso E Super, a combination of verdox, tricyclodecenyl propionate and habanolide; a combination of α-hexyl cinnamic aldehyde, vertenex and tricyclodecenyl propionate; a combination of vertenex, tricyclodecenyl propionate and Iso E Super; a combination of vertenex, tricyclodecenyl propionate and habanolide; a combination of lilial, amyl salicylate and tricyclodecenyl acetate; a combination of lilial, tricyclodecenyl acetate and Iso E Super; a combination of lilial, tricyclodecenyl acetate and habanolide; a combination of α-hexyl cinnamic aldehyde, tetrahydrolinalool and tricyclodecenyl acetate; a combination of tetrahydrolinalool, amyl salicylate and tricyclodecenyl acetate; a combination of tetrahydrolinalool, tricyclodecenyl acetate and Iso E Super; a combination of tetrahydrolinalool, tricyclodecenyl acetate and habanolide; a combination of α-hexyl cinnamic aldehyde, verdox and tricyclodecenyl acetate; a combination of amyl salicylate, verdox and tricyclodecenyl acetate; a combination of verdox, tricyclodecenyl acetate and Iso E Super; a combination of verdox, tricyclodecenyl acetate and habanolide; a combination of α-hexyl cinnamic aldehyde, vertenex and tricyclodecenyl acetate; a combination of amyl salicylate, vertenex and tricyclodecenyl acetate; a combination of vertenex, tricyclodecenyl acetate and Iso E Super; a combination of vertenex, tricyclodecenyl acetate and habanolide; a combination of isobornyl acetate, α-hexyl cinnamic aldehyde and lilial; a combination of isobornyl acetate, lilial and amyl salicylate; a combination of isobornyl acetate, lilial and Iso E Super; a combination of isobornyl acetate, lilial and habanolide; a combination of isobornyl acetate, α-hexyl cinnamic aldehyde and tetrahydrolinalool; a combination of isobornyl acetate, tetrahydrolinalool and amyl salicylate; a combination of isobornyl acetate, tetrahydrolinalool and habanolide; a combination of isobornyl acetate, α-hexyl cinnamic aldehyde and verdox; a combination of isobornyl acetate, amyl salicylate and verdox; a combination of isobornyl acetate, verdox and Iso E Super; a combination of isobornyl acetate, verdox and habanolide; a combination of isobornyl acetate, α-hexyl cinnamic aldehyde and vertenex; a combination of isobornyl acetate, amyl salicylate and vertenex; a combination of isobornyl acetate, vertenex and Iso E Super; a combination of isobornyl acetate, vertenex and habanolide; a combination of dihydromyrcenol, α-hexyl cinnamic aldehyde and lilial; a combination of dihydromyrcenol, lilial and amyl salicylate; a combination of dihydromyrcenol, lilial and Iso E Super; a combination of dihydromyrcenol, lilial and habanolide; a combination of dihydromyrcenol, α-hexyl cinnamic aldehyde and tetrahydrolinalool; a combination of dihydromyrcenol, tetrahydrolinalool and amyl salicylate; a combination of dihydromyrcenol, tetrahydrolinalool and Iso E Super; a combination of dihydromyrcenol, tetrahydrolinalool and habanolide; a combination of dihydromyrcenol, α-hexyl cinnamic aldehyde and habanolide; a combination of dihydromyrcenol, α-hexyl cinnamic aldehyde and verdox; a combination of dihydromyrcenol, amyl salicylate and verdox; a combination of dihydromyrcenol, verdox and Iso E Super; a combination of dihydromyrcenol, α-hexyl cinnamic aldehyde and vertenex; a combination of dihydromyrcenol, amyl salicylate and vertenex; a combination of dihydromyrcenol, vertenex and Iso E Super; or a combination of dihydromyrcenol, vertenex and habanolide, and a fragrance (B) composed of at least one fragrance component selected from the group consisting of allyl cyclohexyl propionate, 1,8-cineole, camphor, diphenyl oxide, β-naphthol methyl ether, citronellyl nitrile, menthone, citronellal, triplal, dodecane nitrile, 3,7-dimethyl-2,6-nonadienenitrile, ethyl 2-methylbutyrate, ethyl 2-methylvalerate and patchouli oil, the mass ratio of the fragrance (A) relative to the fragrance (B), represented by (mass of fragrance (A))/(mass of fragrance (B)), is at least 1 but not more than 10, and the amount of the fragrance (A) is from 0.07 to 0.5% by mass relative to the total mass of the detergent composition.

Yet another aspect of the detergent composition of the present invention contains an α-sulfo fatty acid alkyl ester salt, a fragrance composition, water, a surfactant, and a detergency builder, wherein the amount of the α-sulfo fatty acid alkyl ester salt is from 1 to 30% by mass relative to the total mass of the detergent composition, the fragrance composition contains a fragrance (A) composed of at least one combination selected from the group consisting of a combination of dihydromyrcenol, isobornyl acetate, α-hexyl cinnamic aldehyde, lilial, tetrahydrolinalool, amyl salicylate, verdox, vertenex, tricyclodecenyl acetate, tricyclodecenyl propionate, Iso E Super and habanolide; a combination of dihydromyrcenol, verdox and habanolide; a combination of isobornyl acetate, tetrahydrolinalool and Iso E Super; a combination of amyl salicylate, vertenex and tricyclodecenyl propionate; a combination of α-hexyl cinnamic aldehyde, lilial and tricyclodecenyl acetate; a combination of α-hexyl cinnamic aldehyde, lilial and tricyclodecenyl propionate; a combination of lilial, amyl salicylate and tricyclodecenyl propionate; a combination of lilial, tricyclodecenyl propionate and Iso E Super; a combination of lilial, tricyclodecenyl propionate and habanolide; a combination of α-hexyl cinnamic aldehyde, tetrahydrolinalool and tricyclodecenyl propionate; a combination of tetrahydrolinalool, amyl salicylate and tricyclodecenyl propionate; a combination of tetrahydrolinalool, tricyclodecenyl propionate and Iso E Super; a combination of tetrahydrolinalool, tricyclodecenyl propionate and habanolide; a combination of α-hexyl cinnamic aldehyde, verdox and tricyclodecenyl propionate; a combination of amyl salicylate, verdox and tricyclodecenyl propionate; a combination of verdox, tricyclodecenyl propionate and Iso E Super; a combination of verdox, tricyclodecenyl propionate and habanolide; a combination of α-hexyl cinnamic aldehyde, verdox and tricyclodecenyl propionate; a combination of verdox, tricyclodecenyl propionate and Iso E Super, a combination of verdox, tricyclodecenyl propionate and habanolide; a combination of α-hexyl cinnamic aldehyde, vertenex and tricyclodecenyl propionate; a combination of vertenex, tricyclodecenyl propionate and Iso E Super; a combination of vertenex, tricyclodecenyl propionate and habanolide; a combination of lilial, amyl salicylate and tricyclodecenyl acetate; a combination of lilial, tricyclodecenyl acetate and Iso E Super; a combination of lilial, tricyclodecenyl acetate and habanolide; a combination of α-hexyl cinnamic aldehyde, tetrahydrolinalool and tricyclodecenyl acetate; a combination of tetrahydrolinalool, amyl salicylate and tricyclodecenyl acetate; a combination of tetrahydrolinalool, tricyclodecenyl acetate and Iso E Super; a combination of tetrahydrolinalool, tricyclodecenyl acetate and habanolide; a combination of α-hexyl cinnamic aldehyde, verdox and tricyclodecenyl acetate; a combination of amyl salicylate, verdox and tricyclodecenyl acetate; a combination of verdox, tricyclodecenyl acetate and Iso E Super; a combination of verdox, tricyclodecenyl acetate and habanolide; a combination of α-hexyl cinnamic aldehyde, vertenex and tricyclodecenyl acetate; a combination of amyl salicylate, vertenex and tricyclodecenyl acetate; a combination of vertenex, tricyclodecenyl acetate and Iso E Super; a combination of vertenex, tricyclodecenyl acetate and habanolide; a combination of isobornyl acetate, α-hexyl cinnamic aldehyde and lilial; a combination of isobornyl acetate, lilial and amyl salicylate; a combination of isobornyl acetate, lilial and Iso E Super; a combination of isobornyl acetate, lilial and habanolide; a combination of isobornyl acetate, α-hexyl cinnamic aldehyde and tetrahydrolinalool; a combination of isobornyl acetate, tetrahydrolinalool and amyl salicylate; a combination of isobornyl acetate, tetrahydrolinalool and habanolide; a combination of isobornyl acetate, α-hexyl cinnamic aldehyde and verdox; a combination of isobornyl acetate, amyl salicylate and verdox; a combination of isobornyl acetate, verdox and Iso E Super; a combination of isobornyl acetate, verdox and habanolide; a combination of isobornyl acetate, α-hexyl cinnamic aldehyde and vertenex; a combination of isobornyl acetate, amyl salicylate and vertenex; a combination of isobornyl acetate, vertenex and Iso E Super; a combination of isobornyl acetate, vertenex and habanolide; a combination of dihydromyrcenol, α-hexyl cinnamic aldehyde and lilial; a combination of dihydromyrcenol, lilial and amyl salicylate; a combination of dihydromyrcenol, lilial and Iso E Super; a combination of dihydromyrcenol, lilial and habanolide; a combination of dihydromyrcenol, α-hexyl cinnamic aldehyde and tetrahydrolinalool; a combination of dihydromyrcenol, tetrahydrolinalool and amyl salicylate; a combination of dihydromyrcenol, tetrahydrolinalool and Iso E Super; a combination of dihydromyrcenol, tetrahydrolinalool and habanolide; a combination of dihydromyrcenol, α-hexyl cinnamic aldehyde and habanolide; a combination of dihydromyrcenol, α-hexyl cinnamic aldehyde and verdox; a combination of dihydromyrcenol, amyl salicylate and verdox; a combination of dihydromyrcenol, verdox and Iso E Super; a combination of dihydromyrcenol, α-hexyl cinnamic aldehyde and vertenex; a combination of dihydromyrcenol, amyl salicylate and vertenex; a combination of dihydromyrcenol, vertenex and Iso E Super; or a combination of dihydromyrcenol, vertenex and habanolide, and a fragrance (B) composed of at least one fragrance component selected from the group consisting of allyl cyclohexyl propionate, 1,8-cineole, camphor, diphenyl oxide, β-naphthol methyl ether, citronellyl nitrile, menthone, citronellal, triplal, dodecane nitrile, 3,7-dimethyl-2,6-nonadienenitrile, ethyl 2-methylbutyrate, ethyl 2-methylvalerate and patchouli oil, the mass ratio of the fragrance (A) relative to the fragrance (B), represented by (mass of fragrance (A))/(mass of fragrance (B)), is at least 1 but not more than 10, the amount of the fragrance (A) is from 0.07 to 0.5% by mass relative to the total mass of the detergent composition, and the amount of water is from 2 to 10% by mass relative to the total mass of the detergent composition.

EXAMPLES

The present invention is described below in further detail using a series of examples. However, the present invention is in no way limited by these examples.

In the following description, unless specifically stated otherwise, the units "%" refer to "% by mass".

The raw materials used in each of the following examples are listed below.

<Raw Materials Used>

MES particles: powder of sodium α-sulfo fatty acid methyl ester (MES-Na) (MES-Na purity: 75%, zeolite: 15%, other impurities: 10%, carbon number of MES-Na fatty acid chain: C16/C18=85/15 (mass ratio), product name: MIZU-LAN P82, manufactured by Lion Eco Chemicals Sdn. Bhd.).

LAS-Na: sodium linear alkylbenzene sulfonate (carbon umber of linear alkyl group: 11 to 14), manufactured by Lion Corporation.

STPP: sodium tripolyphosphate, manufactured by Mitsui Chemicals, Inc.

Zeolite: A-type zeolite, manufactured by Mizusawa Industrial Chemicals, Ltd.

Polymer (TL500): acrylic acid-maleic acid copolymer, product name: AQUALIC TL500, manufactured by Nippon Shokubai Co., Ltd.

Silicate: sodium silicate, manufactured by Nippon Chemical Industrial Co., Ltd.

Soda Ash: sodium carbonate, manufactured by Tosoh Corporation.

T-CBS: biphenyl-type fluorescent brightener, product name: Tinopal CBS, manufactured by BASF Corporation.

T-DMAX (conc): stilbene-type fluorescent brightener, product name: Tinopal DMAX, manufactured by BASF Corporation.

$CaCO_3$: calcium carbonate, manufactured by Asahi Kohmatsu Co., Ltd.

$Na_2SO_4$: sodium sulfate, manufactured by Nippon Chemical Industrial Co., Ltd.

Enzyme granules: protease, product name: Deozyme, manufactured by Novozymes Japan Ltd.

<Examples 1 to 4, Comparative Examples 1 and 2>
[Preparation of Base Detergents]

The detergent raw materials shown in Table 1 were mixed to prepare a detergent slurry having a solid content of 60% and a temperature of about 70° C. There were no particular restrictions on the order in which each of the detergent raw materials was added. Following addition of all of the detergent raw materials, the slurry was mixed at 70° C. for about 2 hours, and then a counter-current spray drying tower was used to dry the slurry at a hot air temperature of 260° C. until the moisture content fell to about 5.5% by mass, thus obtaining spray dried particles. In Table 1, the term "Bal" represents the amount added to bring the total mass to a 100% (namely, the balance).

A base detergent (base particles) was obtained by powder mixing 100 parts by mass of the prepared spray dried particles, 10 parts by mass of the MES particles, and 0.5 parts by mass of the enzyme granules.

TABLE 1

| Detergent raw material | Blend amount within spray dried particles (%) |
|---|---|
| LAS-Na | 18 |
| STPP | 16 |

TABLE 1-continued

| Detergent raw material | Blend amount within spray dried particles (%) |
|---|---|
| Zeolite | 2 |
| Polymer (TL500) | 1 |
| Silicate | 8 |
| Soda ash | 10 |
| T-CBS | 0.02 |
| T-DMAX (conc) | 0.02 |
| $CaCO_3$ | 5 |
| $Na_2SO_4$ | Bal |
| water | 5.5 |

[Preparation of Fragrances]

Fragrances (A-1) to (A-6) were prepared as the fragrance (A) by mixing fragrance components in the mass ratios (units: parts by mass) shown in Table 2.

Fragrances (B-1) to (B-6) were prepared as the fragrance (B) by mixing fragrance components in the mass ratios (units: parts by mass) shown in Table 3 and Table 4. Table 3 and Table 4 represent a single continuous table that has been split in two for the sake of convenience, and the fragrance components used in preparing the fragrances (B-1) to (B-6) are indicated by the respective totals of all the fragrance components shown in Table 3 and Table 4.

TABLE 2

| | Fragrance (A) | | | | | |
|---|---|---|---|---|---|---|
| | A-1 | A-2 | A-3 | A-4 | A-5 | A-6 |
| dihydromyrcenol | 10 | 10 | | | | 5 |
| isobornyl acetate | 10 | | 10 | | | |
| α-hexyl cinnamic aldehyde | 10 | | | | 10 | |
| lilial | 10 | | | | 10 | |
| tetrahydrolinalool | 10 | | 10 | | | |
| amyl salicylate | 10 | | | 10 | | |
| verdox | 10 | 10 | | | | |
| vertenex | 10 | | | 10 | | |
| tricyclodecenyl acetate | 10 | | | | 10 | |
| tricyclodecenyl propionate | 10 | | | 10 | | |
| Iso E Super | 10 | | 10 | | | |
| habanolide | 10 | 10 | | | | |

units: parts by mass

TABLE 3

| | Fragrance (B) | | | | | |
|---|---|---|---|---|---|---|
| | B-1 | B-2 | B-3 | B-4 | B-5 | B-6 |
| allyl cyclohexyl propionate | 10 | | | | | |
| 1,8-cineole | 10 | 10 | 10 | | | |
| camphor | 10 | 10 | 10 | | | |
| diphenyl oxide | 10 | | | | | |
| β-naphthol methyl ether | 10 | | | | | |
| citronellyl nitrile | 10 | 10 | 10 | 10 | | |
| menthone | 10 | 10 | 10 | | | |
| citronellal | 10 | | | | | |
| triplal | 10 | | | | 10 | |
| dodecane nitrile | 10 | | | | | |
| 3,7-dimethyl-2,6-nonadienenitrile | 10 | | | | | |
| ethyl 2-methylbutyrate | 10 | 10 | 10 | | | |
| ethyl 2-methylvalerate | 10 | | | | | 10 |
| patchouli oil | 10 | | | | | |

TABLE 3-continued

| | Fragrance (B) | | | | | |
|---|---|---|---|---|---|---|
| | B-1 | B-2 | B-3 | B-4 | B-5 | B-6 |
| n-heptanal | | | | 10 | | |
| n-octanal | | | | 10 | | |
| n-nonanal | | | | 10 | | |
| 1-decanal | | | | 10 | | |
| undecanal | | | | 10 | | |
| dodecanal | | | | 10 | | |
| 2-methylundecanal | | | | 10 | | |
| 10-undecenal | | | | 10 | | |
| terpineol-4 | | | | 10 | | |
| menthol | | | | 10 | | |
| styralyl acetate | | | | 10 | | |
| butyl acetate | | | | 10 | | |
| isoamyl acetate | | 10 | | | | |
| prenyl acetate | | | 10 | | | |
| hexyl acetate | | | | 10 | | |
| cis-3-hexenyl acetate | | 10 | | | | |
| allyl amyl glycolate | | 10 | | | | |
| cis-3-hexenol | | | 10 | | | |
| ethyl 2-cyclohexyl propionate | | | | | | 10 |
| fruitate | | | | | 10 | |
| allyl hexanoate | | 10 | | | | |
| allyl heptanoate | | | | | 10 | |
| ethyl hexanoate | | | 10 | | | |
| ethyl heptanoate | | | | | 10 | |

TABLE 4

| | (Table 3 continued) | | | | | |
|---|---|---|---|---|---|---|
| | B-1 | B-2 | B-3 | B-4 | B-5 | B-6 |
| isomenthone | | | | | 10 | |
| isocyclocitral | | | | | 10 | |
| octyl isobutyrate | | | | | 10 | |
| benzaldehyde | | | 10 | | | |
| anisaldehyde | | | | | 10 | |
| 1,4-cineole | | | | | 10 | |
| allyl ionone | | | | | 10 | |
| floropal | | | | | 10 | |
| linalool oxide | | | | | 10 | |
| rose oxide | | 10 | | | | |
| cyclogalbanate | | 10 | | | | |
| α-dynascone | | | | | 10 | |
| α-damascone | | | | | 10 | |
| β-damascone | | | 10 | | | |
| γ-damascone | | | | | | 10 |
| δ-damascone | | 10 | 10 | | | |
| β-damascenone | | | | | | 10 |
| methyl heptenone | | | | | | 10 |
| L-carvone | | | | | | 10 |
| geranial | | | | | | 10 |
| neral | | | | | | 10 |
| 4-methyl-3-decen-5-ol | | | | | | 10 |
| methyl pamplemousse | | | | | | 10 |
| 3-methyl-1-isobutylbutyl acetate | | | | | | 10 |
| ethyl butyrate | | | 10 | | | |
| cashmeran | | 10 | | | | |
| karanal | | | | | | 10 |
| cedrol methyl ether | | | | | | 10 |
| 2,2,6-trimethylcyclohexyl-3-hexanol | | | | | | 10 |
| methyl naphthyl ketone | | 10 | | | | |
| methyl anthranilate | | | 10 | | | |
| spirogalbanone pure | | | 10 | | | |
| javanol | | | 10 | | | |

units: parts by mass

[Preparation of Granular Detergent Compositions]

In Comparative Example 1, the base detergent described above was used without any further modification as a granular detergent composition.

In Examples 1 to 4 and Comparative Example 2, granular detergent compositions were prepared using the procedure described below.

The fragrance (A), the fragrance (B) and ethanol were mixed together in the blend compositions shown in Table 5 to prepare a series of fragrance compositions. The fragrance (A-1) was used as the fragrance (A), and the fragrance (B-1) was used as the fragrance (B).

Each of the thus obtained fragrance compositions was sprayed onto the base detergent described above to obtain a granular detergent composition.

Table 5 shows the blend amounts (%) of the spray dried particles, the MES particles, the enzyme granules, the fragrance (A), the fragrance (B), and ethanol (the solvent) in each example.

Each of the obtained granular detergent compositions was subjected to the evaluations described below. The results are shown in Table 5.

[Evaluation of Product Aroma]

Forty grams of each prepared granular detergent composition was placed in a glass vial with a capacity of 120 mL and used as an evaluation sample. The aroma of the evaluation sample was evaluated by a sensory evaluation performed by specialist panelists.

In the sensory evaluation, first, the freshly prepared evaluation sample was evaluated by the specialist panelists for its "sense of freshness as a detergent" against the 5-point scale described below, with a score of 4 points or more being deemed a pass.

5 points: a sense of freshness as a detergent is detected.

4 points: some sense of freshness as a detergent is detected.

3 points: a slight sense of freshness as a detergent is detected.

2 points: almost no sense of freshness as a detergent is detected.

1 point: no sense of freshness as a detergent is detected.

Further, a prepared evaluation sample was stored for 2 weeks in a 50° C. thermostatic chamber, the aroma after storage was compared with that prior to storage, and the "lack of unpleasant odors" was evaluated by the specialist panelists against the 5-point scale described below, with a score of 4 points or more being deemed a pass.

5 points: absolutely no unpleasant odors.

4 points: almost no unpleasant odors.

3 points: slight unpleasant odors detected.

2 points: considerable unpleasant odors detected.

1 point: extremely unpleasant odors detected.

TABLE 5

| | | Comparative Example | | Example | | | |
|---|---|---|---|---|---|---|---|
| | | 1 | 2 | 1 | 2 | 3 | 4 |
| Sample No. | | fragrance-free sample | No. 1 | No. 2 | No. 3 | No. 4 | No. 5 |
| Fragrance (A) No. | | — | A-1 | A-1 | A-1 | A-1 | A-1 |
| Blend composition (% by mass) | spray dried particles | 90.50 | 90.08 | 90.08 | 90.08 | 90.09 | 90.08 |
| | MES particles | 9.05 | 9.01 | 9.01 | 9.01 | 9.01 | 9.01 |
| | enzyme granules | 0.45 | 0.45 | 0.45 | 0.45 | 0.45 | 0.45 |
| | fragrance (A) | 0 | 0.05 | 0.09 | 0.14 | 0.23 | 0.32 |
| | fragrance (B) | 0 | 0.05 | 0.05 | 0.05 | 0.05 | 0.05 |
| | ethanol (solvent) | 0 | 0.36 | 0.32 | 0.27 | 0.18 | 0.09 |
| Evaluation results | sense of freshness as detergent | 1 | 3 | 4 | 4 | 4 | 4 |
| | lack of unpleasant odors | 1 | 3 | 4 | 4 | 5 | 5 |

As is evident from the above results, compared with the granular detergent composition of Comparative Example 1 which used the base detergent (fragrance-free sample) without further modification, the granular detergent compositions of Examples 1 to 4 prepared by adding a fragrance composition containing the fragrances (A) and (B) to the base detergent each had a product aroma that produced a satisfactory sense of freshness as a detergent, and also exhibited almost no change in the aroma following storage.

In contrast, the product aroma of the granular detergent composition of Comparative Example 2 which contained only 0.05% by mass of the fragrance (A) exhibited an inferior sense of freshness as a detergent compared with Examples 1 to 4, despite containing the same amount of the fragrance (B) that imparts the sense of freshness as a detergent. The change in the aroma after storage was also greater than that observed in Examples 1 to 4.

These results confirmed that by adding at least the prescribed amount of the fragrance (A), deterioration in the product aroma caused by odors derived from the MES, and inhibition of the development of the aroma of the fragrance (B) could be suppressed.

Examples 5 to 23, Comparative Examples 3 to 5

The fragrance (A), the fragrance (B) and ethanol were mixed together in the blend compositions shown in Tables 6 to 10 to prepare a series of fragrance compositions. For the fragrance (A), the fragrances shown in Tables 6 to 10 were used, and for the fragrance (B), the fragrances (B-1) to (B-3) were used. In Tables 6 to 9, the fragrance (B-1) was used as the fragrance (B).

Each of the thus obtained fragrance compositions was sprayed onto the base detergent described above to obtain a granular detergent composition.

Tables 6 to 10 show the blend amounts (%) of the spray dried particles, the MES particles, the enzyme granules, the fragrance (A), the fragrance (B), and ethanol (the solvent) in each example.

Each of the obtained granular detergent compositions was evaluated for product aroma using the same procedure as that described above. The results are shown in Tables 6 to 10.

TABLE 6

| | | Example | | | | Comparative Example |
|---|---|---|---|---|---|---|
| | | 5 | 6 | 7 | 8 | 3 |
| Sample No. | | No. 6 | No. 7 | No. 8 | No. 9 | No. 10 |
| Fragrance (A) No. | | A-2 | A-3 | A-4 | A-5 | A-6 |
| Blend composition (% by mass) | spray dried particles | 90.08 | 90.08 | 90.08 | 90.08 | 90.09 |
| | MES particles | 9.01 | 9.01 | 9.01 | 9.01 | 9.01 |
| | enzyme granules | 0.45 | 0.45 | 0.45 | 0.45 | 0.45 |
| | fragrance (A) | 0.14 | 0.14 | 0.14 | 0.14 | 0.02 |
| | fragrance (B) | 0.05 | 0.05 | 0.05 | 0.05 | 0.05 |
| | ethanol (solvent) | 0.27 | 0.27 | 0.27 | 0.27 | 0.38 |
| Evaluation results | sense of freshness as detergent | 4 | 4 | 4 | 4 | 3 |
| | lack of unpleasant odors | 4 | 4 | 4 | 4 | 3 |

TABLE 7

| | | Example | | | | Comparative Example |
|---|---|---|---|---|---|---|
| | | 9 | 10 | 11 | 12 | 4 |
| Sample No. | | No. 11 | No. 12 | No. 13 | No. 14 | No. 15 |
| Fragrance (A) No. | | A-2 | A-3 | A-4 | A-5 | A-6 |
| Blend composition (% by mass) | spray dried particles | 90.29 | 90.29 | 90.29 | 90.29 | 90.30 |
| | MES particles | 9.03 | 9.03 | 9.03 | 9.03 | 9.03 |
| | enzyme granules | 0.45 | 0.45 | 0.45 | 0.45 | 0.45 |
| | fragrance (A) | 0.07 | 0.07 | 0.07 | 0.07 | 0.01 |
| | fragrance (B) | 0.02 | 0.02 | 0.02 | 0.02 | 0.02 |
| | ethanol (solvent) | 0.14 | 0.14 | 0.14 | 0.14 | 0.19 |
| Evaluation results | sense of freshness as detergent | 4 | 4 | 4 | 4 | 2 |
| | lack of unpleasant odors | 4 | 4 | 4 | 4 | 2 |

TABLE 8

| | | Example | | | | Comparative Example |
|---|---|---|---|---|---|---|
| | | 13 | 14 | 15 | 16 | 5 |
| Sample No. | | No. 16 | No. 17 | No. 18 | No. 19 | No. 20 |
| Fragrance (A) No. | | A-2 | A-3 | A-4 | A-5 | A-6 |
| Blend composition (% by mass) | spray dried particles | 89.68 | 89.68 | 89.68 | 89.68 | 89.69 |
| | MES particles | 8.97 | 8.97 | 8.97 | 8.97 | 8.97 |
| | enzyme granules | 0.45 | 0.45 | 0.45 | 0.45 | 0.45 |
| | fragrance (A) | 0.27 | 0.27 | 0.27 | 0.27 | 0.04 |
| | fragrance (B) | 0.09 | 0.09 | 0.09 | 0.09 | 0.09 |
| | ethanol (solvent) | 0.54 | 0.54 | 0.54 | 0.54 | 0.76 |
| Evaluation results | sense of freshness as detergent | 4 | 4 | 4 | 4 | 3 |
| | lack of unpleasant odors | 5 | 5 | 5 | 5 | 3 |

TABLE 9

| | | Example | | | | |
|---|---|---|---|---|---|---|
| | | 17 | 18 | 19 | 20 | 21 |
| Sample No. | | No. 21 | No. 22 | No. 23 | No. 24 | No. 25 |
| Fragrance (A) No. | | A-2 | A-2 | A-2 | A-2 | A-3 |
| Blend composition (% by mass) | spray dried particles | 98.04 | 86.21 | 82.65 | 90.09 | 90.08 |
| | MES particles | 0.98 | 12.93 | 16.53 | 9.01 | 9.01 |
| | enzyme granules | 0.49 | 0.43 | 0.41 | 0.45 | 0.45 |
| | fragrance (A) | 0.15 | 0.13 | 0.12 | 0.20 | 0.27 |
| | fragrance (B) | 0.05 | 0.04 | 0.04 | 0.05 | 0.05 |
| | ethanol (solvent) | 0.29 | 0.26 | 0.25 | 0.20 | 0.14 |
| Evaluation results | sense of freshness as detergent | 5 | 4 | 4 | 5 | 5 |
| | lack of unpleasant odors | 5 | 4 | 4 | 5 | 5 |

TABLE 10

| | | Example | |
|---|---|---|---|
| | | 22 | 23 |
| Sample No. | | No. 26 | No. 27 |
| Fragrance (A) No. | | A-2 | A-3 |
| Fragrance (B) No. | | B-3 | B-2 |
| Blend composition (% by mass) | spray dried particles | 98.04 | 90.09 |
| | MES particles | 0.98 | 9.01 |
| | enzyme granules | 0.49 | 0.45 |
| | fragrance (A) | 0.15 | 0.27 |
| | fragrance (B) | 0.05 | 0.05 |
| | ethanol (solvent) | 0.29 | 0.14 |
| Evaluation results | sense of freshness as detergent | 5 | 5 |
| | lack of unpleasant odors | 5 | 5 |

As is evident from the above results, the granular detergent compositions of Examples 5 to 23, in which the base detergent was imparted with an aroma using a fragrance composition containing the fragrance (A) and the fragrance (B), each had a product aroma that produced a satisfactory sense of freshness as a detergent, and also exhibited almost no change in the aroma following storage, in a similar manner to that observed for the aforementioned Examples 1 to 4.

In contrast, the product aroma of the granular detergent composition of Comparative Example 3 which contained only 0.02% by mass of the fragrance (A) exhibited an inferior sense of freshness as a detergent compared with Examples 5 to 8, despite containing the same amount of the fragrance (B) that imparts the sense of freshness as a detergent. The change in the aroma after storage was also greater than that observed in Examples 5 to 8.

Similarly, the product aroma of the granular detergent composition of Comparative Example 4 which contained only 0.01% by mass of the fragrance (A) exhibited an inferior sense of freshness as a detergent compared with Examples 9 to 12, despite containing the same amount of the fragrance (B), and also exhibited a greater change in the aroma after storage.

Further, the product aroma of the granular detergent composition of Comparative Example 5 which contained 0.04% by mass of the fragrance (A) exhibited an inferior sense of freshness as a detergent compared with Examples 13 to 16, despite containing the same amount of the fragrance (B), and also exhibited a greater change in the aroma after storage.

Test Example 1

For each of the granular detergent compositions obtained in Examples 1 to 4 and Comparative Examples 1 and 2, the granular detergent composition was stored in a container, and the components that existed in the head space portion of the container were analyzed using the procedure described below.

Three grams of the granular detergent composition was weighed accurately and placed in a vial with a capacity of 20 mL, the vial was sealed, and following standing for 30 minutes in a 40° C. thermostatic chamber, the components contained within the head space portion were extracted for one hour at 40° C. into a solid-phase microextraction fiber (SPME fiber, manufactured by Supelco Inc., film thickness: 65 μm, PDMS/DVB (divinylbenzene-dispersed polydimethylsiloxane)).

Following the extraction, the SPME fiber was analyzed using a GC-MS manufactured by Agilent Technologies, Inc. (Agilent 7890/5975C) and an HP-INNOWax column (length: 30 m, inner diameter: 0.25 mm, film thickness: 0.25 μm), under conditions including a measurement temperature that was held at 35° C. for 3 minutes, subsequently increased to 205° C. at a rate of 4° C./minute, and then further increased to 250° C. at 10° C./minute, helium as the carrier gas, an injection temperature of 250° C., an interface temperature of 250° C., and a splitless injection method.

Based on the results of the above analysis, the amounts extracted of alkyl methyl ketones having an alkyl group with a carbon number of 4 to 8 (namely, $CH_3$—C(=O)—R wherein the carbon number of R is from 4 to 8) were measured, and the amount (ng) of each alkyl methyl ketone extracted from the head space portion was determined.

Further, based on these results, a total extraction amount (C4 to C8 total) was calculated for the combination of all of the alkyl methyl ketones having an alkyl group with a carbon number of 4 to 8. Furthermore, with the extraction amount of each alkyl methyl ketone in Comparative Example 1 deemed to be 1, the ratio (relative to the fragrance-free sample) of the alkyl methyl ketone extraction amount relative to this value of 1 was calculated for each of Comparative Example 2 and Examples 1 to 4. The results are shown in Table 11.

TABLE 11

| | | Comparative Example | | Example | | | |
|---|---|---|---|---|---|---|---|
| | | 1 | 2 | 1 | 2 | 3 | 4 |
| Sample No. | | fragrance-free sample | No. 1 | No. 2 | No. 3 | No. 4 | No. 5 |
| Fragrance (A) No. | | — | A-1 | A-1 | A-1 | A-1 | A-1 |
| Amount of fragrance (A) (% by mass) | | 0 | 0.05 | 0.09 | 0.14 | 0.23 | 0.32 |
| Alkyl methyl ketone SPME fiber extraction amount (ng) | C4 | 2.19 | 0.13 | 0.11 | 0.09 | 0.09 | 0.08 |
| | C5 | 3.60 | 0.39 | 0.36 | 0.27 | 0.26 | 0.25 |
| | C6 | 3.91 | 1.03 | 0.91 | 0.71 | 0.64 | 0.57 |
| | C7 | 3.84 | 2.26 | 1.98 | 1.63 | 1.43 | 1.29 |
| | C8 | 2.73 | 2.04 | 1.84 | 1.63 | 1.52 | 1.39 |
| | C4 to C8 total | 16.26 | 5.86 | 5.20 | 4.33 | 3.94 | 3.58 |
| Alkyl methyl ketone ratio relative to fragrance-free sample | C4 | 1.00 | 0.06 | 0.05 | 0.04 | 0.04 | 0.04 |
| | C5 | 1.00 | 0.11 | 0.10 | 0.07 | 0.07 | 0.07 |
| | C6 | 1.00 | 0.26 | 0.23 | 0.18 | 0.16 | 0.15 |
| | C7 | 1.00 | 0.59 | 0.52 | 0.43 | 0.37 | 0.34 |
| | C8 | 1.00 | 0.75 | 0.67 | 0.60 | 0.56 | 0.51 |

The above results confirmed that, by adding the fragrance (A), the amount of alkyl methyl ketones having an alkyl group with a carbon number of 4 to 8 extracted from the head space decreased, with the rate of that decrease more dramatic for ketones having an alkyl group with a smaller carbon number.

Further, based on the above results and the results shown in Table 5, it was evident that the larger the amount added of the fragrance (A), the more the evaluation results for the product aroma improved, and the greater the tendency was for the measured amounts of alkyl methyl ketones to decrease. Accordingly, it is thought that the amount of these alkyl methyl ketones is useful as an indicator for evaluating the effect of the invention in suppressing the odors derived from the MES.

Production Examples 1 to 60

Fragrances 1 to 60 were prepared as the fragrance (A) by mixing fragrance components in the mass ratios (units: parts by mass) shown in Tables 12 to 14.

With the exception of then using each of the fragrances 1 to 60 instead of the fragrance (A-1), granular detergent compositions were prepared in the same manner as Example 3. In a similar manner to that observed for the granular detergent composition of Example 3, each of the obtained granular detergent compositions had a product aroma that produced a satisfactory sense of freshness as a detergent, and also exhibited almost no change in the aroma following storage.

TABLE 12

| | Fragrance (A) | | | | | | | | | | | | | | | | | | | |
|---|---|---|---|---|---|---|---|---|---|---|---|---|---|---|---|---|---|---|---|---|
| Fragrance No. | 1 | 2 | 3 | 4 | 5 | 6 | 7 | 8 | 9 | 10 | 11 | 12 | 13 | 14 | 15 | 16 | 17 | 18 | 19 | 20 |
| dihydromyrcenol | | | | | | | | | | | | | | | | | | | | |
| isobornyl acetate | | | | | | | | | | | | | | | | | | | | |
| α-hexyl cinnamic aldehyde | 10 | | | | 10 | | | | 10 | | | | 10 | | | | | | 10 | |
| lilial | 10 | 10 | 10 | 10 | | | | | | | | | | | | 10 | 10 | 10 | | |
| tetrahydrolinalool | | | | | 10 | 10 | 10 | 10 | | | | | | | | | | | 10 | 10 |
| amyl salicylate | | 10 | | | | 10 | | | | 10 | | | | | | 10 | | | | 10 |
| verdox | | | | | | | | | 10 | 10 | 10 | 10 | | | | | | | | |
| vertenex | | | | | | | | | | | | | 10 | 10 | 10 | | | | | |
| tricyclodecenyl acetate | | | | | | | | | | | | | | | | 10 | 10 | 10 | 10 | 10 |
| tricyclodecenyl propionate | 10 | 10 | 10 | 10 | 10 | 10 | 10 | 10 | 10 | 10 | 10 | 10 | 10 | 10 | 10 | | | | | |
| Iso E Super | | | 10 | | | | 10 | | | | 10 | | | 10 | | | 10 | | | |
| habanolide | | | | 10 | | | | 10 | | | | 10 | | | 10 | | | 10 | | |

units: parts by mass

TABLE 13

| | Fragrance (A) | | | | | | | | | | | | | | | | | | | |
|---|---|---|---|---|---|---|---|---|---|---|---|---|---|---|---|---|---|---|---|---|
| Fragrance No. | 21 | 22 | 23 | 24 | 25 | 26 | 27 | 28 | 29 | 30 | 31 | 32 | 33 | 34 | 35 | 36 | 37 | 38 | 39 | 40 |
| dihydromyrcenol | | | | | | | | | | | | | | | | | | | | |
| isobornyl acetate | | | | | | | | | | | 10 | 10 | 10 | 10 | 10 | 10 | 10 | 10 | 10 | 10 |
| α-hexyl cinnamic aldehyde | | | 10 | | | | 10 | | | | 10 | | | | 10 | | | 10 | | |
| lilial | | | | | | | | | | | 10 | 10 | 10 | 10 | | | | | | |
| tetrahydrolinalool | 10 | 10 | | | | | | | | | | | | | 10 | 10 | 10 | | | |
| amyl salicylate | | | | 10 | | | | 10 | | | | 10 | | | | 10 | | | 10 | |
| verdox | | | 10 | 10 | 10 | 10 | | | | | | | | | | | | 10 | 10 | 10 |
| vertenex | | | | | | | 10 | 10 | 10 | 10 | | | | | | | | | | |
| tricyclodecenyl acetate | 10 | 10 | 10 | 10 | 10 | 10 | 10 | 10 | 10 | 10 | | | | | | | | | | |
| tricyclodecenyl propionate | | | | | | | | | | | | | | | | | | | | |
| Iso E Super | 10 | | | | 10 | | | | 10 | | | | 10 | | | | | | | 10 |
| habanolide | | 10 | | | | 10 | | | | 10 | | | | 10 | | | 10 | | | |

units: parts by mass

TABLE 14

| | Fragrance (A) | | | | | | | | | | | | | | | | | | | |
|---|---|---|---|---|---|---|---|---|---|---|---|---|---|---|---|---|---|---|---|---|
| Fragrance No. | 41 | 42 | 43 | 44 | 45 | 46 | 47 | 48 | 49 | 50 | 51 | 52 | 53 | 54 | 55 | 56 | 57 | 58 | 59 | 60 |
| dihydromyrcenol | | | | | | 10 | 10 | 10 | 10 | 10 | 10 | 10 | 10 | 10 | 10 | 10 | 10 | 10 | 10 | 10 |
| isobornyl acetate | 10 | 10 | 10 | 10 | 10 | | | | | | | | | | | | | | | |
| α-hexyl cinnamic aldehyde | | 10 | | | | 10 | | | | 10 | | | | 10 | | | 10 | | | |
| lilial | | | | | | 10 | 10 | 10 | 10 | | | | | | | | | | | |
| tetrahydrolinalool | | | | | | | | | | 10 | 10 | 10 | 10 | | | | | | | |
| amyl salicylate | | | 10 | | | | 10 | | | | 10 | | | | 10 | | | 10 | | |
| verdox | 10 | | | | | | | | | | | | | 10 | 10 | 10 | | | | |
| vertenex | | 10 | 10 | 10 | 10 | | | | | | | | | | | | 10 | 10 | 10 | 10 |
| tricyclodecenyl acetate | | | | | | | | | | | | | | | | | | | | |
| tricyclodecenyl propionate | | | | | | | | | | | | | | | | | | | | |
| Iso E Super | | | | 10 | | | | 10 | | | | 10 | | | | 10 | | | 10 | |
| habanolide | 10 | | | | 10 | | | | 10 | | | | 10 | | | | | | | 10 |

units: parts by mass

INDUSTRIAL APPLICABILITY

The present invention is able to provide a detergent composition with a favorable aroma in which the effects of odors derived from α-sulfo fatty acid alkyl ester salts are suppressed.

What is claimed:

1. A detergent comprising an α-sulfo fatty acid alkyl ester salt and a fragrance composition, wherein an amount of the α-sulfo fatty acid alkyl ester salt is from 1 to 30% by mass relative to a total mass of the detergent composition, the fragrance composition comprises a fragrance (A) described below, an amount of the fragrance (A) is from 0.07 to 0.5% by mass relative to a total mass of the detergent composition, an amount of the fragrance (A) within the fragrance composition is at least 20% by mass relative to the total mass of the fragrance composition, and the fragrance (A) is composed of at least one fragrance component selected from the group consisting of dihydromyrcenol, isobornyl acetate, α-hexyl cinnamic aldehyde, lilial, tetrahydrolinalool, amyl salicylate, verdox, vertenex, tricyclodecenyl acetate, tricyclodecenyl propionate, Iso E Super and habanolide.

2. A detergent composition comprising an α-sulfo fatty acid alkyl ester salt and a fragrance composition, wherein an amount of the α-sulfo fatty acid alkyl ester salt is from 1 to 30% by mass relative to a total mass of the detergent composition, the fragrance composition comprises a fragrance (A) described below, an amount of the fragrance composition is from 0.25 to 1% by mass relative to a total mass of the detergent composition, and an amount of the fragrance (A) within the fragrance composition is at least 20% by mass relative to the total mass of the fragrance composition, and the fragrance (A) is composed of at least one fragrance component selected from the group consisting of dihydromyrcenol, isobornyl acetate, α-hexyl cinnamic aldehyde, lilial, tetrahydrolinalool, amyl salicylate, verdox, vertenex, tricyclodecenyl acetate, tricyclodecenyl propionate, Iso E Super, and habanolide.

3. The detergent composition according to claim 2, wherein the fragrance composition also comprises a fragrance (B) described below, a mass ratio of the fragrance (A) relative to the fragrance (B), represented by (mass of fragrance (A))/(mass of fragrance (B)), is at least 1 but not more than 10, and the fragrance (B) is composed of at least one fragrance component selected from the group consisting of 3,7-dimethyl-2,6-nonadienenitrile, allyl cyclohexyl propionate, triplal, 1,8-cineole, camphor, diphenyl oxide, β-naphthol methyl ether, citronellyl nitrile, dodecane nitrile, menthone, ethyl 2-methylbutyrate, ethyl 2-methylvalerate, citronellal, patchouli oil, n-heptanal, n-octanal, n-nonanal, 1-decanal, undecanal, dodecanal, 2-methylundecanal, 10-undecenal, terpineol-4, menthol, styralyl acetate, butyl acetate, isoamyl acetate, prenyl acetate, hexyl acetate, cis-3-hexenyl acetate, allyl amyl glycolate, cis-3-hexenol, ethyl 2-cyclohexyl propionate, fruitate, allyl hexanoate, allyl heptanoate, ethyl hexanoate, ethyl heptanoate, isomenthone, isocyclocitral, octyl isobutyrate, benzaldehyde, anisaldehyde, 1,4-cineole, allyl ionone, floropal, linalool oxide, rose oxide, cyclogalbanate, α-dynascone, α-damascone, β-damascone, γ-damascone, δ-damascone, β-damascenone, methyl heptenone, L-carvone, geranial, neral, 4-methyl-3-decen-5-ol, methyl pamplemousse, 3-methyl-1-isobutylbutyl acetate, ethyl butyrate, cashmeran, karanal, cedrol methyl ether, 2,2,6-trimethylcyclohexyl-3-hexanol, methyl naphthyl ketone, methyl anthranilate, spirogalbanone pure, and javanol.

4. The detergent composition according to claim 3, wherein the fragrance (A) is composed of at least three fragrance components.

5. The detergent composition according to claim 2, wherein the fragrance (A) is composed of at least three fragrance components.

6. The detergent composition according to claim 1, wherein the fragrance composition also comprises a fragrance (B) described below, a mass ratio of the fragrance (A) relative to the fragrance (B), represented by (mass of fragrance (A))/(mass of fragrance (B)), is at least 1 but not more than 10, and the fragrance (B) is composed of at least one fragrance component selected from the group consisting of 3,7-dimethyl-2,6-nonadienenitrile, allyl cyclohexyl propionate, triplal, 1,8-cineole, camphor, diphenyl oxide, β-naphthol methyl ether, citronellyl nitrile, dodecane nitrile, menthone, ethyl 2-methylbutyrate, ethyl 2-methylvalerate, citronellal, patchouli oil, n-heptanal, n-octanal, n-nonanal, 1-decanal, undecanal, dodecanal, 2-methylundecanal, 10-undecenal, terpineol-4, menthol, styralyl acetate, butyl acetate, isoamyl acetate, prenyl acetate, hexyl acetate, cis-3-hexenyl acetate, allyl amyl glycolate, cis-3-hexenol, ethyl 2-cyclohexyl propionate, fruitate, allyl hexanoate, allyl heptanoate, ethyl hexanoate, ethyl heptanoate, isomenthone, isocyclocitral, octyl isobutyrate, benzaldehyde, anisaldehyde, 1,4-cineole, allyl ionone, floropal, linalool oxide, rose oxide, cyclogalbanate, α-dynascone, α-damascone, β-damascone, γ-damascone, δ-damascone, β-damascenone, methyl heptenone, L-carvone, geranial, neral, 4-methyl-3-decen-5-ol, methyl pamplemousse, 3-methyl-1-isobutylbutyl acetate, ethyl butyrate, cashmeran, karanal, cedrol methyl ether, 2,2,6-trimethylcyclohexyl-3-hexanol, methyl naphthyl ketone, methyl anthranilate, spirogalbanone pure, and javanol.

7. The detergent composition according to claim 6, wherein the fragrance (A) is composed of at least three fragrance components.

8. The detergent composition according to claim 1, wherein the fragrance (A) is composed of at least three fragrance components.

9. The detergent composition according to claim 1, wherein the fragrance (A) is composed of at least three fragrance component selected from the group consisting of dihydromyrcenol, isobornyl acetate, α-hexyl cinnamic aldehyde, lilial, tetrahydrolinalool, amyl salicylate, verdox, vertenex, tricyclodecenyl acetate, tricyclodecenyl propionate, Iso E Super, and habanolide.

10. The detergent composition according to claim 1, wherein the fragrance (A) is composed of at least one fragrance component selected from the group (a), at least one fragrance component selected from the group (b), and at least one fragrance component selected from the group (c), the group (a) is consisting of dihydromyrcenol, isobornyl acetate, tricyclodecenyl acetate and tricyclodecenyl propionate, the group (b) is consisting of α-hexyl cinnamic aldehyde, amyl salicylate, Iso E Super and habanolide, and the group (c) is consisting of lilial, tetrahydrolinalool, verdox and vertenex.

11. The detergent composition according to claim 1, wherein the fragrance (A) is a combination (a), a combination (b), a combination (c) or the combination (d), the combination (a) is composed of at least one fragrance component selected from the group consisting of dihydromyrcenol, isobornyl acetate, tricyclodecenyl acetate and tricyclodecenyl propionate, and at least one of fragrance component selected from the group consisting of α-hexyl cinnamic aldehyde, amyl salicylate, Iso E Super and habanolide, the combination (b) is composed of at least one fragrance component selected from the group consisting of dihydromyrcenol, isobornyl acetate, tricyclodecenyl acetate and tricyclodecenyl propionate, and at least one of fragrance component selected from the group consisting of lilial, tetrahydrolinalool, verdox and vertenex, the combination (c) is composed of at least one of fragrance component selected from the group consisting of α-hexyl cinnamic aldehyde, amyl salicylate, Iso E Super and habanolide, and at least one of fragrance component selected from the group consisting of filial, tetrahydrolinalool, verdox and vertenex, and the combination (d) is composed of at least one fragrance component selected from the group consisting of dihydromyrcenol, isobornyl acetate, tricyclodecenyl acetate and tricyclodecenyl propionate, at least one of fragrance component selected from the group consisting of α-hexyl cinnamic aldehyde, amyl salicylate, Iso E Super and habanolide, and at least one of fragrance component selected from the group consisting of lilial, tetrahydrolinalool, verdox and vertenex.

12. The detergent composition according to claim 1, wherein the fragrance (A) is a combination (1), a combination (2), a combination (3), a combination (4), a combination (5), a combination (6), a combination (7), a combination (8), a combination (9), a combination (10), a combination (11), a combination (12), a combination (13), a combination (14), a combination (15), a combination (16), a combination (17), a combination (18), a combination (19), a combination (20), a combination (21), a combination (22), a combination (23), a combination (24), a combination (25), a combination (26), a combination (27), a combination (28), a combination (29), a combination (30), a combination (31), a combination (32), a combination (33), a combination (34), a combination (35), a combination (36), a combination (37), a combination (38), a combination (39), a combination (40), a combination (41), a combination (42), a combination (43), a combination (44), a combination (45), a combination (46), a combination (47), a combination (48), a combination (49), a combination (50), a combination (51), a combination (52), a combination (53), a combination (54), a combination (55), a combination (56), a combination (57), a combination (58), a combination (59), a combination (60), a combination (61), a combination (62), a combination (63), a combination (64), a combination (65), a combination (66), a combination (67), a combination (68) or a combination (69), the combination (1) is composed of dihydromyrcenol, isobornyl acetate, α-hexyl cinnamic aldehyde, lilial, tetrahydrolinalool, amyl salicylate, verdox, vertenex, tricyclodecenyl acetate, tricyclodecenyl propionate, Iso E Super, and habanolide, the combination (2) is composed of dihydromyrcenol, verdox and habanolide, the combination (3) is composed of tricyclodecenyl acetate, tetrahydrolinalool and Iso E Super, the combination (4) is composed of amyl salicylate, vertenex and tricyclodecenyl propionate, the combination (5) is composed of α-hexyl cinnamic aldehyde, lilial and tricyclodecenyl acetate, the combination (6) is composed of α-hexyl cinnamic aldehyde, lilial and tricyclodecenyl propionate, the combination (7) is composed of lilial, amyl salicylate and tricyclodecenyl propionate, the combination (8) is composed of lilial, tricyclodecenyl propionate and Iso E Super, the combination (9) is composed of lilial, tricyclodecenyl propionate and habanolide, the combination (10) is composed of α-hexyl cinnamic aldehyde, tetrahydrolinalool and tricyclodecenyl propionate, the combination (11) is composed of tetrahydrolinalool, amyl salicylate and tricyclodecenyl propionate, the combination (12) is composed of tetrahydrolinalool, tricyclodecenyl propionate and Iso E Super, the combination (13) is composed of tetrahydrolinalool, tricyclodecenyl propionate and habanolide, the combination (14) is composed of α-hexyl cinnamic aldehyde, verdox and tricyclodecenyl propionate, the combination (15) is composed of amyl salicylate, verdox and tricyclodecenyl propionate, the combination (16) is composed of verdox, tricyclodecenyl propionate and Iso E Super, the combination (17) is composed of verdox, tricyclodecenyl propionate and habanolide, the combination (18) is composed of α-hexyl cinnamic aldehyde, verdox and tricyclodecenyl propionate, the combination (19) is composed of verdox, tricyclodecenyl propionate and Iso E Super, the combination (20) is composed of verdox, tricyclodecenyl propionate and habanolide, the combination (21) is composed of α-hexyl cinnamic aldehyde, vertenex and tricyclodecenyl propionate, the combination (22) is composed of vertenex, tricyclodecenyl propionate and Iso E Super, the combination (23) is composed of vertenex, tricyclodecenyl propionate and habanolide, the combination (24) is composed of lilial, amyl salicylate and tricyclodecenyl acetate, the combination (25) is composed of lilial, tricyclodecenyl acetate and Iso E Super, the combination (26) is composed of lilial, tricyclodecenyl acetate and habanolide, the combination (27) is composed of α-hexyl cinnamic aldehyde, tetrahydrolinalool and tricyclodecenyl acetate, the combination (28) is composed of tetrahydrolinalool, amyl salicylate and tricyclodecenyl acetate, the combination (29) is composed of tetrahydrolinalool, tricyclodecenyl acetate and Iso E Super, the combination (30) is composed of tetrahydrolinalool, tricyclodecenyl acetate and habanolide, the combination (31) is composed of α-hexyl cinnamic aldehyde, verdox and tricyclodecenyl acetate, the combination (32) is composed of amyl salicylate, verdox and tricyclodecenyl acetate, the combination (33) is composed of verdox, tricyclodecenyl acetate and Iso E Super, the combination (34) is composed of verdox, tricyclodecenyl acetate and habanolide, the combination (35) is composed of α-hexyl cinnamic aldehyde, vertenex and tricyclodecenyl acetate, the combination (36) is composed of amyl salicylate, vertenex and tricyclodecenyl acetate, the combination (37) is composed of vertenex, tricyclodecenyl acetate and Iso E Super, the combination (38) is composed of vertenex, tricyclodecenyl acetate and habanolide, the combination (39) is composed of isobornyl acetate, α-hexyl cinnamic aldehyde and lilial, the combination (40) is composed of isobornyl acetate, lilial and amyl salicylate, the combination (41) is composed of isobornyl acetate, lilial and Iso E Super, the combination (42) is composed of isobornyl acetate, lilial and habanolide, the combination (43) is composed of isobornyl acetate, α-hexyl cinnamic aldehyde and tetrahydrolinalool, the combination (44) is composed of isobornyl acetate, tetrahydrolinalool and amyl salicylate, the combination (45) is composed of isobornyl acetate, tetrahydrolinalool and habanolide, the combination (46) is composed of isobornyl acetate, α-hexyl cinnamic aldehyde and verdox, the combination (47) is composed of isobornyl acetate, amyl salicylate and verdox, the combination (48) is composed of isobornyl acetate, verdox and Iso E Super, the combination (49) is composed of isobornyl acetate, verdox and habanolide, the combination (50) is composed of isobornyl acetate, α-hexyl cinnamic aldehyde and vertenex, the combination (51) is composed of isobornyl acetate, amyl salicylate and vertenex, the combination (52) is composed of isobornyl acetate, vertenex and Iso E Super, the combination (53) is composed of isobornyl acetate, vertenex and habanolide, the combination (54) is composed of dihydromyrcenol, α-hexyl cinnamic aldehyde and lilial, the combination (55) is composed of dihydromyrcenol, filial and amyl salicylate, the combination (56) is composed of dihydromyrcenol, filial and Iso E Super, the combination (57) is composed of dihydromyrcenol, filial and habanolide, the combination (58) is composed of dihydromyrcenol, α-hexyl cinnamic aldehyde and tetrahydrolinalool, the combination (59) is composed of dihydromyrcenol, tetrahydrolinalool and amyl salicylate, the combination (60) is composed of dihydromyrcenol, tetrahydrolinalool and Iso E Super, the combination (61) is composed of dihydromyrcenol, tetrahydrolinalool and habanolide, the combination (62) is composed of dihydromyrcenol, α-hexyl cinnamic aldehyde and habanolide, the combination (63) is composed of dihydromyrcenol, α-hexyl cinnamic aldehyde and verdox, the combination (64) is composed of dihydromyrcenol, amyl salicylate and verdox, the combination (65) is composed of dihydromyrcenol, verdox and Iso E Super, the combination (66) is composed of dihydromyrcenol, α-hexyl cinnamic aldehyde and vertenex, the combination (67) is composed of dihydromyrcenol, amyl salicylate and vertenex, the combination (68) is composed of dihydromyrcenol, vertenex and Iso E Super, and the combination (69) is composed of dihydromyrcenol, vertenex and habanolide.

* * * * *